US009895900B2

(12) United States Patent
Kobayashi et al.

(10) Patent No.: US 9,895,900 B2
(45) Date of Patent: Feb. 20, 2018

(54) LIQUID CARTRIDGE HAVING STRUCTURE FOR OPENING AND CLOSING LIQUID CHANNEL AND AIR CHANNEL

(71) Applicant: BROTHER KOGYO KABUSHIKI KAISHA, Nagoya-shi, Aichi-ken (JP)

(72) Inventors: Tetsuro Kobayashi, Nagoya (JP); Akihito Ono, Nagoya (JP); Naoya Okazaki, Gifu-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/213,901

(22) Filed: Jul. 19, 2016

(65) Prior Publication Data

US 2017/0021635 A1 Jan. 26, 2017

(30) Foreign Application Priority Data

Jul. 21, 2015 (JP) ..... 2015-143965
Jul. 21, 2015 (JP) ..... 2015-143966
Jul. 21, 2015 (JP) ..... 2015-143968

(51) Int. Cl.
*B41J 2/175* (2006.01)

(52) U.S. Cl.
CPC ..... *B41J 2/17596* (2013.01); *B41J 2/175* (2013.01); *B41J 2/1752* (2013.01); *B41J 2/17513* (2013.01); *B41J 2/17523* (2013.01); *B41J 2/17553* (2013.01); *B41J 2/17559* (2013.01)

(58) Field of Classification Search
CPC ..... B41J 2/17523
See application file for complete search history.

(56) References Cited

U.S. PATENT DOCUMENTS

2004/0165042 A1 8/2004 Ichihashi et al.
2004/0165043 A1 8/2004 Sakai et al.
2004/0165045 A1 8/2004 Sakai et al.
2004/0174418 A1 9/2004 Toba et al.
2005/0088497 A1 4/2005 Katayama et al.
2008/0230141 A1* 9/2008 Hattori ..... B41J 2/17506 141/18

(Continued)

FOREIGN PATENT DOCUMENTS

JP 2003-300330 A 10/2003
JP 2005-47242 A 2/2005

(Continued)

*Primary Examiner* — Shelby Fidler
(74) *Attorney, Agent, or Firm* — Merchant & Gould P.C.

(57) ABSTRACT

A liquid cartridge includes a resin frame, a valve and a wall member. The frame defines a portion of a liquid chamber configured to store liquid and a portion of a valve chamber in communication with the liquid chamber, the valve chamber extending in a first direction away from the liquid chamber and having one end in the first direction at which a liquid outlet is provided to provide communication between the valve chamber and an outside of the liquid cartridge, the frame having a wall portion defining a portion of the valve chamber. The valve is disposed within the valve chamber and movable in a second direction opposite the first direction, the valve having a closing part configured to open and close the liquid outlet in accordance with movement of the valve. The wall member defines the valve chamber together with the wall portion of the frame.

23 Claims, 17 Drawing Sheets

(56) References Cited

U.S. PATENT DOCUMENTS

| | | | | |
|---|---|---|---|---|
| 2009/0141101 | A1 | 6/2009 | Takagi | |
| 2009/0141103 | A1 | 6/2009 | Takagi | |
| 2009/0141105 | A1 | 6/2009 | Sasaki | |
| 2011/0310194 | A1* | 12/2011 | Takagi | ..... B41J 2/17509 347/86 |

FOREIGN PATENT DOCUMENTS

| | | | |
|---|---|---|---|
| JP | 2006-062377 | A | 3/2006 |
| JP | 2009-133458 | A | 6/2009 |
| JP | 4506301 | B2 | 7/2010 |

* cited by examiner

LIQUID CARTRIDGE HAVING STRUCTURE FOR OPENING AND CLOSING LIQUID CHANNEL AND AIR CHANNEL

CROSS REFERENCE TO RELATED APPLICATION

This application claims priority from Japanese Patent Application Nos. 2015-143965 filed Jul. 21, 2015, 2015-143966 filed Jul. 21, 2015 and 2015-143968 filed Jul. 21, 2015. The entire contents of these priority applications are incorporated herein by reference.

TECHNICAL FIELD

The present disclosure relates to a liquid cartridge configured to store liquid therein that can be flow out therefrom.

BACKGROUND

An inkjet-recording device well known in the art has a recording head and is configured to record images on sheets by ejecting ink stored in an ink cartridge onto the sheets through nozzles formed in the recording head. When ink in the ink cartridge is consumed through image-recording operations performed by the inkjet-recording device, the empty ink cartridge is removed and replaced with a new ink cartridge filled with ink.

One ink cartridge known in the art has an ink supply chamber that can provide communication between an ink chamber storing ink and the exterior of the ink cartridge. One end of the ink supply chamber is in communication with the ink chamber, while the other end is in communication with the exterior of the ink cartridge through an ink outlet. Within the ink supply chamber, a valve member is disposed. The valve member can move to open and close the ink outlet, controlling whether ink stored in the ink chamber can be supplied out of the ink cartridge. The ink cartridge having this construction is described in Japanese Patent Application Publication No. 2006-62377.

Another conventional ink cartridge includes an ink supply part for supplying ink through an ink channel, and an air communication part that can provide communication between a layer of air in an ink chamber that stores ink and the exterior of the ink cartridge through an air channel. The air communication part is closed when the ink cartridge is stored so that the ink chamber is kept enclosed. When the ink cartridge is mounted in an inkjet-recording device, the air communication part is opened so that the ink chamber can communicate with external air.

Japanese Patent No. 4506301 discloses an ink cartridge that employs a single valve mechanism for opening and closing both the ink channel and the air channel.

Japanese Patent Application Publication No. 2003-300330 describes an ink cartridge having a structure that opens the air communication part to external air before the ink supply part can communicate with the recording head. The air communication part is preferably opened to the external air before the ink supply unit is in communication with the recording head. This is because, if the air communication part were to be opened to the external air after the ink supply part becomes in communication with the recording head when the ink cartridge is in a high-altitude region in which the atmospheric pressure is lower than the internal pressure of the ink chamber, an excessive amount of ink may be supplied from the ink chamber to the recording head, causing ink meniscus in individual nozzles of the recording head to break.

SUMMARY

In some cases, the valve member provided within the ink supply chamber may have a lengthy moving range. For example, the valve member may need to move over a longer range when functioning, not only to open and close the ink outlet, but also to open and close the air channel providing communication between the layer of air in the ink chamber and the exterior of the ink cartridge. The moving range of the valve member may also be made longer in an ink cartridge that can prevent outflow of ink when the ink outlet is opened due to unintentional movement of the valve member. This ink cartridge may be configured to prevent the ink outlet from being opened when the valve member moves only a short distance and to allow the ink outlet to open only when the valve member has moved a prescribed distance.

In order to ensure that the valve member can be moved reliably over a longer range, it is preferable that the valve member be surrounded by a frame that defines the ink supply chamber. Accordingly, when manufacturing the ink cartridge through resin-molding, a hollow region should be formed in a molded product (i.e., the frame) with a length adequate for the moving range of the valve member.

When molding the ink cartridge with resin, a pin is disposed in a die in an area that will become the hollow region for the valve member. If the hollow region must be long as in the cases described above, there is a higher probability that the pin will become tilted during a molding step in a cartridge manufacturing process due to pressure applied by resin when the resin is poured into the die. If the pin becomes tilted, the area defining the ink supply chamber in the ink cartridge cannot be molded precisely.

In view of the foregoing, it is an object of the present disclosure to provide a liquid cartridge whose parts that define the space for accommodating the valve member can be precisely molded, even when the valve member has a considerably long moving range.

Further, in the conventional ink cartridge using a single valve mechanism to open and close both the ink channel and air channel, there is a need to more reliably supply ink out of the ink cartridge from the ink chamber through the ink channel opened by the valve mechanism.

In view of the foregoing, it is another object of the present disclosure to provide a liquid cartridge capable of more reliably supplying liquid stored in a liquid chamber out of the liquid cartridge.

Further, in the conventional ink cartridge described in Japanese unexamined patent application publication No. 2003-300330, a problem may arise if the ink cartridge is mounted in the inkjet-recording head at a high speed. That is, even when the air communication part is opened to the external air before the ink supply part communicates with the recording head, there is a chance that the ink supply part will be able to communicate with the recording head before the internal pressure of the ink chamber becomes equalized with the atmospheric pressure. If the ink supply part communicates with the recording head before the pressure in the ink chamber becomes equal to the atmospheric pressure, an excessive amount of ink may be supplied from the ink chamber to the recording head, breaking the ink meniscus in individual nozzles of the recording head.

In view of the foregoing, it is still another object of the present disclosure to provide a liquid cartridge capable of preventing liquid stored in a liquid chamber from flowing out of the chamber due to its internal pressure.

In order to attain the above and other objects, the present disclosure provides a liquid cartridge including a resin frame, a valve and a wall member. The frame defines: a portion of a liquid chamber configured to store liquid; and a portion of a valve chamber in communication with the liquid chamber, the valve chamber extending in a first direction away from the liquid chamber and having one end in the first direction at which a liquid outlet is provided to provide communication between the valve chamber and an outside of the liquid cartridge, the frame having a wall portion defining a portion of the valve chamber. The valve is disposed within the valve chamber and is movable in a second direction opposite the first direction, the valve having a closing part configured to open and close the liquid outlet in accordance with movement of the valve. The wall member defines the valve chamber together with the wall portion of the frame.

According to another aspect, the present disclosure provides a liquid cartridge including: a liquid chamber configured to store liquid therein; a valve chamber in communication with the liquid chamber; a liquid outlet; a first air channel; a second air channel; a valve; a first sealing part; a second sealing part; a third sealing part; and a liquid channel. The valve chamber is defined at least by a base wall surface and a peripheral wall surface, the peripheral wall surface extending in a first direction away from the liquid chamber and having an annular-shaped cross-section taken along a plane orthogonal to the first direction, the peripheral wall surface being formed with a first opening and a second opening, the second opening being positioned further in a second direction opposite the first direction relative to the first opening. The liquid outlet is provided at one end of the valve chamber in the first direction to provide communication between the valve chamber and outside of the liquid chamber. The first air channel connects the first opening and an outside of the liquid cartridge to provide communication between the valve chamber and ambient air. The second air channel connects the second opening and the liquid chamber to provide communication between the liquid chamber and the valve chamber. The valve is movably disposed within the valve chamber, the valve having a closing part configured to open and close the liquid outlet in accordance with movement of the valve, the valve being formed with a through-hole extending in the first direction. The first sealing part is provided on an outer surface of the valve and has an annular shape when viewed in the first direction, the first sealing part being configured to be in close contact with the peripheral wall surface and slide relative thereto in accordance with movement of the valve. The second sealing part is provided on the outer surface of the valve and has an annular shape when viewed in the first direction, the second sealing part being positioned further in the first direction relative to the first sealing part, the second sealing part being configured to be in close contact with the peripheral wall surface and slide relative thereto in accordance with the movement of the valve. The third sealing part is provided on the outer surface of the valve, the third sealing part being positioned further in the second direction relative to the first sealing part, the third sealing part being configured to be in close contact with the peripheral wall surface and slide relative thereto in accordance with the movement of the valve. The liquid channel connects between the liquid chamber and the liquid outlet via the through-hole formed in the valve. The valve is movable, in the first direction and in the second direction, between a first state and a second state. In the first state, the closing part closes the liquid outlet; the first sealing part is positioned between the first opening and the second opening to interrupt air flow between the first opening and the second opening; the second sealing part is positioned further in the first direction relative to the first opening; the third sealing part interrupts liquid flow between the second opening and the liquid channel. In the second state, the closing part opens the liquid outlet; and the first opening and the second opening are positioned between the first sealing part and the second sealing part to provide air flow between the first opening and the second opening. The valve at the second state is positioned further in the second direction relative to the valve at the first state.

According to still another aspect, the present disclosure provides a liquid cartridge including: a liquid chamber configured to store liquid therein; a liquid outlet configured to allow liquid flow therethrough; a liquid channel; a first closing part; an air channel; a second closing part; and a third closing part. The liquid channel connects between the liquid chamber and the liquid outlet to allow the liquid to flow in a flowing direction from the liquid chamber toward the liquid outlet. The first closing part is configured to open and close the liquid outlet. The air channel extends from the liquid chamber to an outside of the liquid cartridge to provide communication between the liquid chamber and ambient air. The second closing part is configured to open and close the air channel. The third closing part is provided in the liquid channel and is configured to open and close the liquid channel, the third closing part having a first surface facing upstream in the flowing direction and a second surface opposite the first surface and facing downstream in the flowing direction, the third closing part being configured to deflect between a closed state and an open state based on a first pressure applied to the first surface and a second pressure applied to the second surface, a difference between the first pressure and the second pressure being defined by subtracting a value of the second pressure from a value of the first pressure, the third closing part deflecting into the closed state when the difference is equal to or greater than a predetermined threshold value, the third closing part deflecting into the open state when the difference is smaller than the predetermined threshold value.

According to still another aspect, there is also provided a liquid ejecting device including: a liquid cartridge; a cartridge receiving section configured to receive the liquid cartridge; a liquid ejecting head; a connecting member; and a purging mechanism. The liquid cartridge includes: a liquid chamber configured to store liquid therein; a liquid outlet configured to allow liquid flow therethrough; a liquid channel connecting between the liquid chamber and the liquid outlet to allow the liquid to flow in a flowing direction from the liquid chamber toward the liquid outlet; a first closing part configured to open and close the liquid outlet; an air channel extending from the liquid chamber to an outside of the liquid cartridge to provide communication between the liquid chamber and ambient air; a second closing part configured to open and close the air channel; and a third closing part provided in the liquid channel and configured to open and close the liquid channel, the third closing part having a first surface facing upstream in the flowing direction and a second surface opposite the first surface and facing downstream in the flowing direction, the third closing part being configured to deflect between a closed state and an open state based on a first pressure applied to the first surface and a second pressure applied to the second surface, a difference between the first pressure and the second pressure being defined by subtracting a value of the second pressure from a value of the first pressure, the third closing part deflecting into the closed state when the difference is equal to or greater than a predetermined threshold value, the third closing part deflecting into the open state when the difference is smaller than the predetermined threshold value. The connecting member connects the liquid ejecting head and the liquid outlet of the liquid cartridge received in the cartridge receiving section to provide communication between the liquid ejecting head and the liquid outlet. The purging mechanism is configured to draw liquid from the liquid ejecting head. The predetermined threshold value is larger than a value obtained by subtracting a value of the second pressure applied to the second surface when the purging mechanism draws the liquid from the liquid ejecting head from a value of the first pressure applied to the first surface when the air channel is opened.

According to still another aspect, there is also provided a method of manufacturing a liquid cartridge. The liquid cartridge includes: a liquid chamber configured to store liquid therein; a liquid outlet configured to allow liquid flow therethrough; a liquid channel connecting between the liquid chamber and the liquid outlet to allow the liquid to flow in a flowing direction from the liquid chamber toward the liquid outlet; a first closing part configured to open and close the liquid outlet; an air channel extending from the liquid chamber to an outside of the liquid cartridge to provide communication between the liquid chamber and ambient air; a second closing part configured to open and close the air channel; and a third closing part provided in the liquid channel and configured to open and close the liquid channel, the third closing part having a first surface facing upstream in the flowing direction and a second surface opposite the first surface and facing downstream in the flowing direction, the third closing part being configured to deflect between a closed state and an open state based on a first pressure applied to the first surface and a second pressure applied the second surface, a difference between the first pressure and the second pressure being defined by subtracting a value of the second pressure from a value of the first pressure, the third closing part deflecting into the closed state when the difference is equal to or greater than a predetermined threshold value, the third closing part deflecting into the open state when the difference is smaller than the predetermined threshold value. The method includes: decompressing the liquid chamber through the air channel; introducing liquid into the liquid chamber through the liquid channel after decompressing the liquid chamber; adjusting pressure within the liquid chamber to be greater than atmospheric pressure by at least the threshold value after introducing the liquid into the liquid chamber; and sealing the liquid chamber off from ambient air after adjusting the pressure within the liquid chamber.

DETAILED DESCRIPTION

Figure 1:
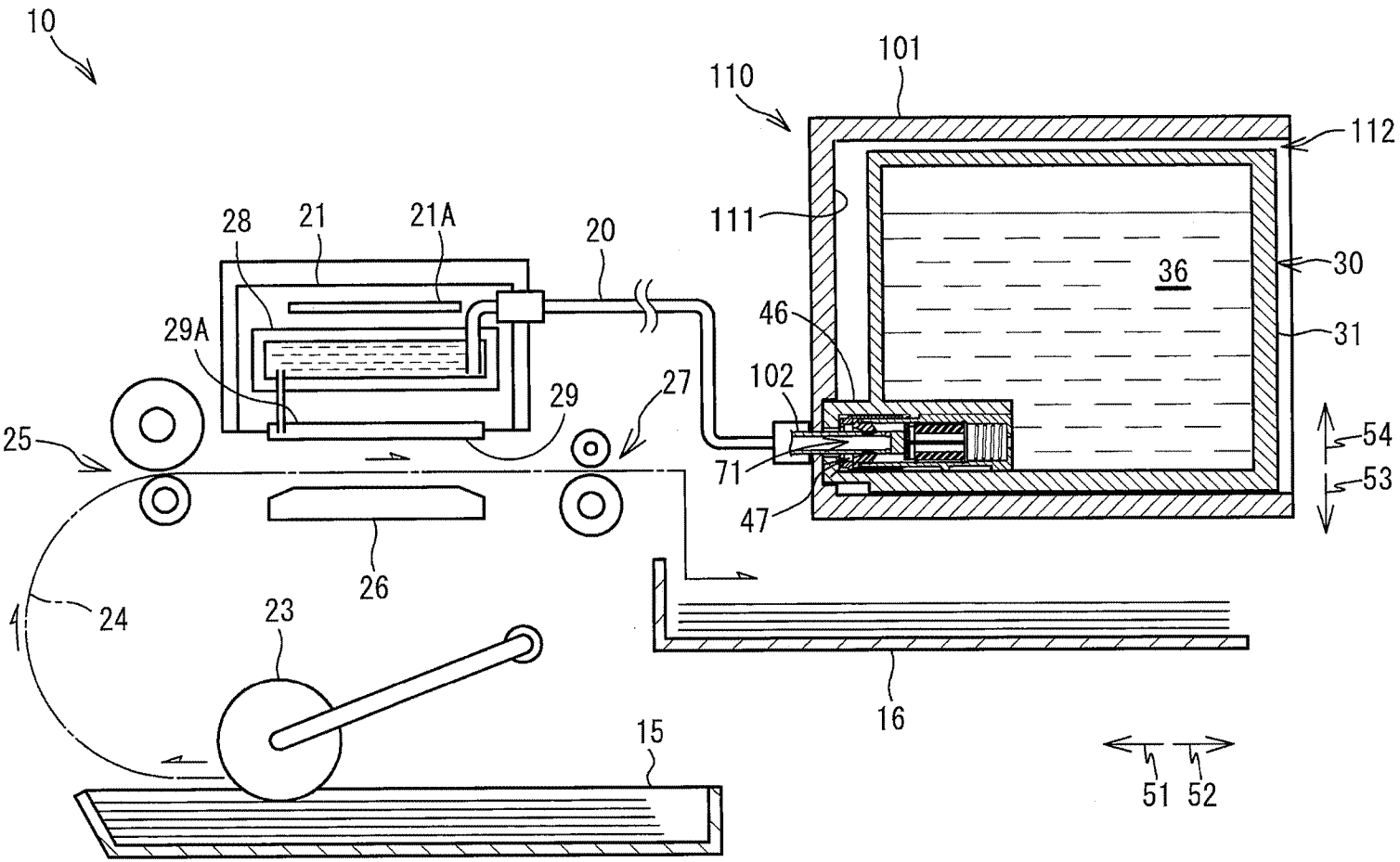
FIG. 1 is a conceptual cross-sectional view showing an internal construction of a printer provided with a cartridge-receiving section 110 that can detachably receive an ink cartridge 30 according to a first embodiment of the present disclosure.

First, a first embodiment of the present disclosure will be described while referring to FIGS. 1 through 13.

In the following description, a mounting direction 51 is defined as a direction that an ink cartridge 30 is inserted into a cartridge-receiving section 110, and a removing direction 52 is defined as a direction opposite the mounting direction 51, that is, a direction in which the ink cartridge 30 is extracted from the cartridge-receiving section 110. While the mounting and removing directions 51 and 52 are horizontal directions in the present disclosure, the mounting and removing directions 51 and 52 need not be horizontal directions. Further, a downward direction 53 is defined as the direction of gravitational force acting on the ink cartridge 30 and an upward direction 54 is defined as a direction opposite the gravitational direction when the ink cartridge 30 has been inserted into the cartridge-receiving section 110, i.e., when the ink cartridge 30 is in an operational state. Further, a rightward direction 55 and a leftward direction 56 are defined based on a perspective of a user viewing the side of the ink cartridge 30 facing in the mounting direction 51. The rightward and leftward directions 55 and 56 are opposite to each other and orthogonal to the mounting and removing directions 51 and 52 and the downward and upward directions 53 and 54.

Unless otherwise stated, the following description will assume that the ink cartridge 30 is in its operational state. Here, the operational state of the ink cartridge 30 denotes an orientation of the ink cartridge 30 when mounted in the cartridge-receiving section 110 of a printer 10 and capable of being used thereby, for example. In other words, the mounting and removing directions 51 and 52 are horizontal when ink cartridge 30 is in the operational state.

1. First Embodiment

<Overview of the Printer 10>

FIG. 1 shows the printer 10 (an example of a liquid ejecting device) configured to record images on recording sheets by selectively ejecting ink droplets onto the sheets based on an inkjet-recording method. The printer 10 includes the cartridge-receiving section 110 for receiving the ink cartridge 30 therein as an example of a cartridge receiving section.

The cartridge-receiving section 110 has one surface formed with an opening 112. The ink cartridge 30 (as an example of a liquid cartridge) is inserted into the cartridge-receiving section 110 in the mounting direction 51 and extracted from the cartridge-receiving section 110 in the removing direction 52 through the opening 112. The mounting direction 51 is an example of a first direction, and the removing direction 52 is an example of a second direction.

The ink cartridge 30 is configured to store ink (as an example of liquid) that the printer 10 can use for printing. It should be noted here that, in the printer 10 of the present embodiment, four kinds of ink cartridges 30 corresponding to four colors of cyan, magenta, yellow and black can be mounted in the cartridge-receiving section 110. However, for an explanatory purpose, in the following description and accompanying drawings, only one ink cartridge 30 is assumed to be accommodated in the cartridge accommodating section 110.

Figure 2:
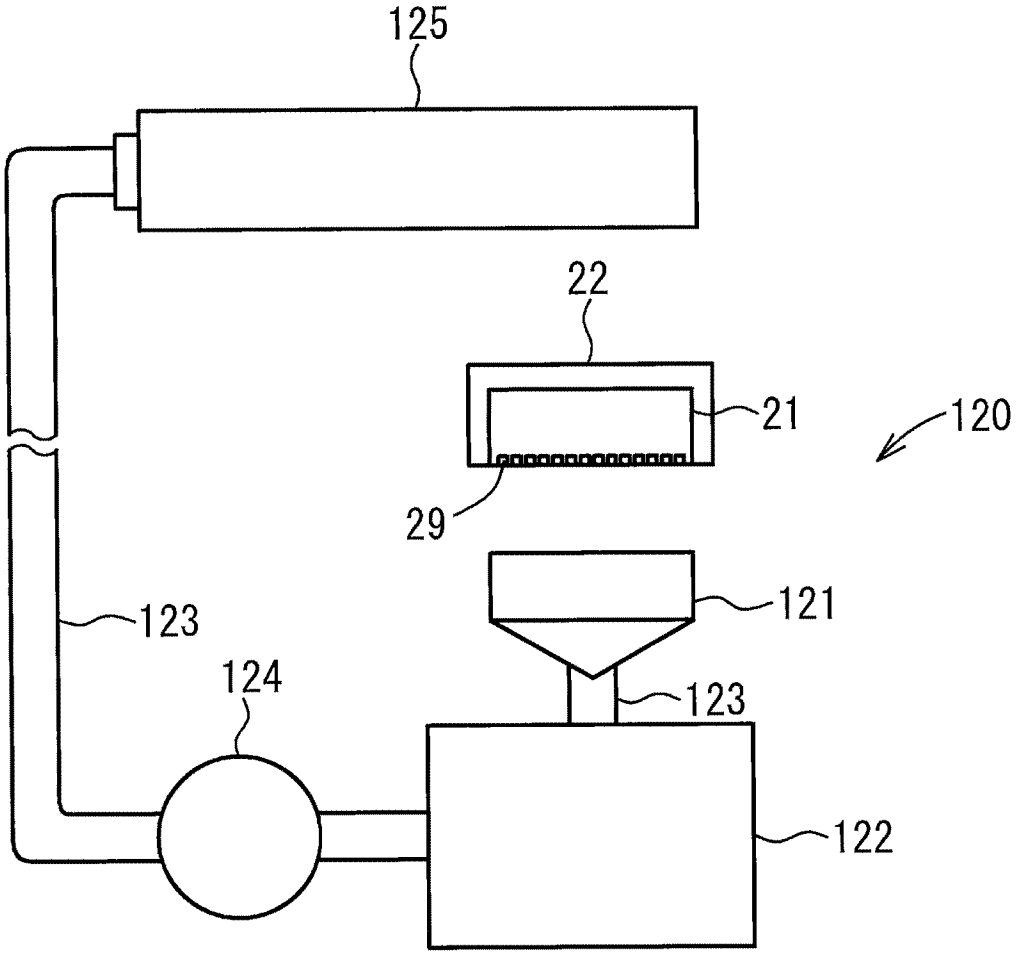
FIG. 2 is a diagram conceptually showing structures of a purging mechanism 120, a recording head 21 and a carriage 22 according to the first embodiment.

The printer 10 also includes a recording head 21 (as an example of a recording head), an ink tube 20 (as an example of a connecting member) connecting the recording head 21 to the cartridge-receiving section 110, and a purging mechanism 120 as an example of a purging mechanism (see FIG. 2).

The ink tube 20 provides communication between the recording head 21 and a through-hole 71 described later formed in the ink cartridge 30 when the ink cartridge 30 is in the operational state.

The recording head 21 is provided with a sub-tank 28, and nozzles 29. The sub-tank 28 temporarily holds ink to be supplied through the ink tube 20. The recording head 21 selectively ejects ink supplied from the sub-tank 28 through the nozzles 29 according to the inkjet-recording method. More specifically, the recording head 21 is provided with a head control board 21A, and piezoelectric elements 29A corresponding one-on-one to the nozzles 29. The head control board 21A is configured to selectively apply drive voltages to the piezoelectric elements 29A in order to eject ink selectively from the nozzles 29.

The printer 10 also includes a sheet tray 15, a feeding roller 23, a conveying path 24, a pair of conveying rollers 25, a platen 26, a pair of discharge rollers 27, and a discharge tray 16. In the printer 10, the feeding roller 23 is configured to feed sheets of paper from the sheet tray 15 onto the conveying path 24, and the conveying rollers 25 convey the sheets over the platen 26. The recording head 21 is configured to selectively eject ink onto each sheet as the sheet passes over the platen 26, whereby an image is recorded on each sheet. The discharge rollers 27 are configured to receive the sheet that has passed over the platen 26 and discharge the sheet onto the discharge tray 16 provided on a downstream end of the conveying path 24.

In the first embodiment, the recording head 21 is mounted in a movable carriage 22 (see FIG. 2). Through movements of the carriage 22, the recording head 21 can be made movable between a printing position directly above the conveying path 24, and a retracted position not directly above the conveying path 24. The recording head 21 is moved to the printing position when ejecting ink onto the sheets and is moved to the retracted position in order for the purging mechanism 120 to draw ink out of the recording head 21.

The purging mechanism 120 shown in FIG. 2 is configured to use suction to extract ink from the nozzles 29 formed in the recording head 21. The purging mechanism 120 is disposed directly beneath the recording head 21 when the recording head 21 is at the retracted position.

The purging mechanism 120 includes a cap 121 capable of covering the nozzles 29, a cam mechanism 122 for moving the cap 121 up and down, a tube 123 through which ink can flow, a pump 124 for drawing ink, and a waste ink tank 125 for collecting the extracted ink.

Note that FIG. 2 schematically depicts the purging mechanism 120 in order to illustrate how the tube 123 connects the cap 121 to the waste ink tank 125. Hence, the positional relationships of components in FIG. 2 do not necessarily represent the positional relationships of components in the first embodiment accurately.

The cap 121 is configured of a rubber material. The cap 121 can confront the recording head 21 from below when the recording head 21 is in its retracted position. The cam mechanism 122 is driven by a motor (not shown). When driven, the cam mechanism 122 moves the cap 121 up and down. When the cam mechanism 122 moves the cap 121 in the upward direction 54, the cap 121 contacts a bottom surface of the recording head 21 and covers the nozzles 29. When the cam mechanism 122 moves the cap 121 in the downward direction 53, the cap 121 separates from the recording head 21.

The cap 121 is connected to one end of the tube 123. The tube 123 is a flexible tube formed of a resin material. The other end of the tube 123 is connected to the waste ink tank 125. Thus, through the tube 123, the cap 121 is in communication with the waste ink tank 125.

In the first embodiment, the pump 124 is a rotary tube pump. The pump 124 has a pump casing provided with an inner wall surface, and revolving rollers that can move along the inner wall surface. The tube 123 is arranged between the inner wall surface and the rollers. The rollers are configured to be driven to revolve by a motor (not shown). When driven to revolve, the rollers squeeze the tube 123, causing ink in the nozzles 29 to be drawn out into the tube 123. The ink in the tube 123 is then forced to move from an upstream side (the cap 121 end) toward a downstream side (the waste ink tank 125 end).

[Cartridge-Receiving Section 110]

As shown in FIG. 1, the ink cartridge 30 can be mounted in the cartridge-receiving section 110. When the ink cartridge 30 is in its operational state, ink stored in the ink cartridge 30 is transported to the ink tube 20 through the cartridge-receiving section 110 and through the ink tube 20 to the recording head 21.

The cartridge-receiving section 110 also includes a case 101, and an ink needle 102. Note that FIG. 1 shows a state where the ink cartridge 30 has been completely mounted in the cartridge-receiving section 110, i.e., the ink cartridge 30 is in its operational state. As mentioned earlier, although not shown in the drawings, the cartridge-receiving section 110 can accommodate four of the ink cartridges 30 corresponding to the ink colors cyan, magenta, yellow, and black.

[Ink Needle 102]

As shown in FIG. 1, the opening 112 is formed in one end of the case 101 positioned furthest downstream in the removing direction 52. The case 101 has an inner surface 111 positioned furthest downstream in the mounting direction 51. This inner surface 111 facing the opening 112 in the mounting and removing directions 51 and 52 will be called an inner back surface 111 of the case 101. The ink needle 102 protrudes in the removing direction 52 from the inner back surface 111 of the case 101. The ink needle 102 is arranged at such a position on the inner back surface 111 that the ink needle 102 can confront a cylindrical wall 46 of the ink cartridge 30 described later.

Figure 11:
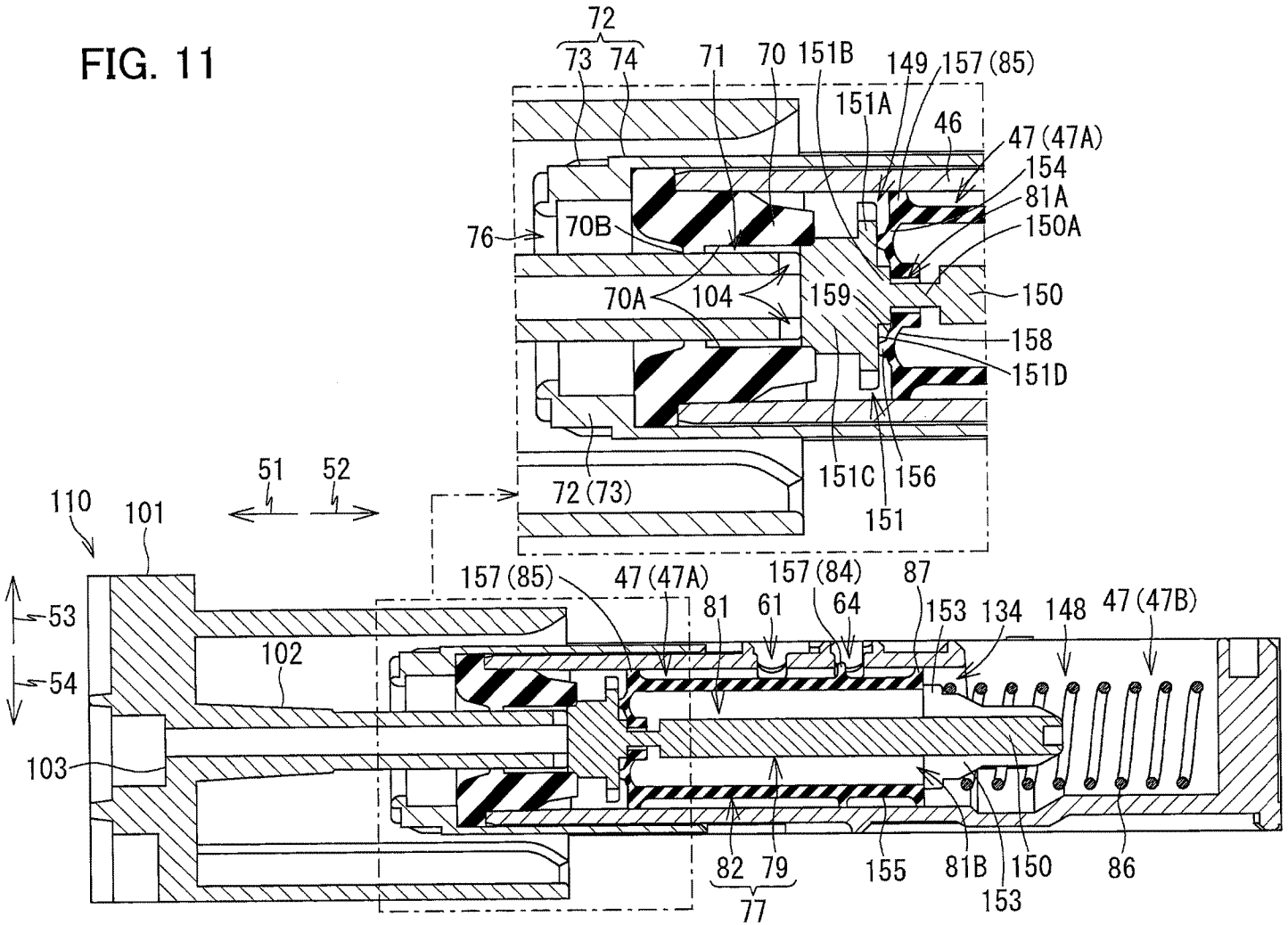
FIG. 11 is a cross-sectional view of the ink cartridge 30 according to the first embodiment taken along a plane corresponding to the plane B-B shown in FIG. 9A, wherein the valve 77 is in its intermediate state.

As shown in FIG. 11, the ink needle 102 is a tube-like needle formed of a resin material. A liquid channel is formed longitudinally through a center portion of the ink needle 102. The ink needle 102 has a distal end (downstream end in the removing direction 52) that has a circumferential wall in which a pair of communication holes 104 is formed. The ink needle 102 has a base end 103 (downstream end in the mounting direction 51) that is connected to the ink tube 20, but the ink tube 20 has been omitted from FIGS. 9B and 11-13. The pair of the communication holes 104 is formed at opposing positions with respect to an axis of the ink needle 102. The communication holes 104 provide fluid communication between the interior and exterior of the ink needle 102 so that ink can flow therethrough.

Figure 13:
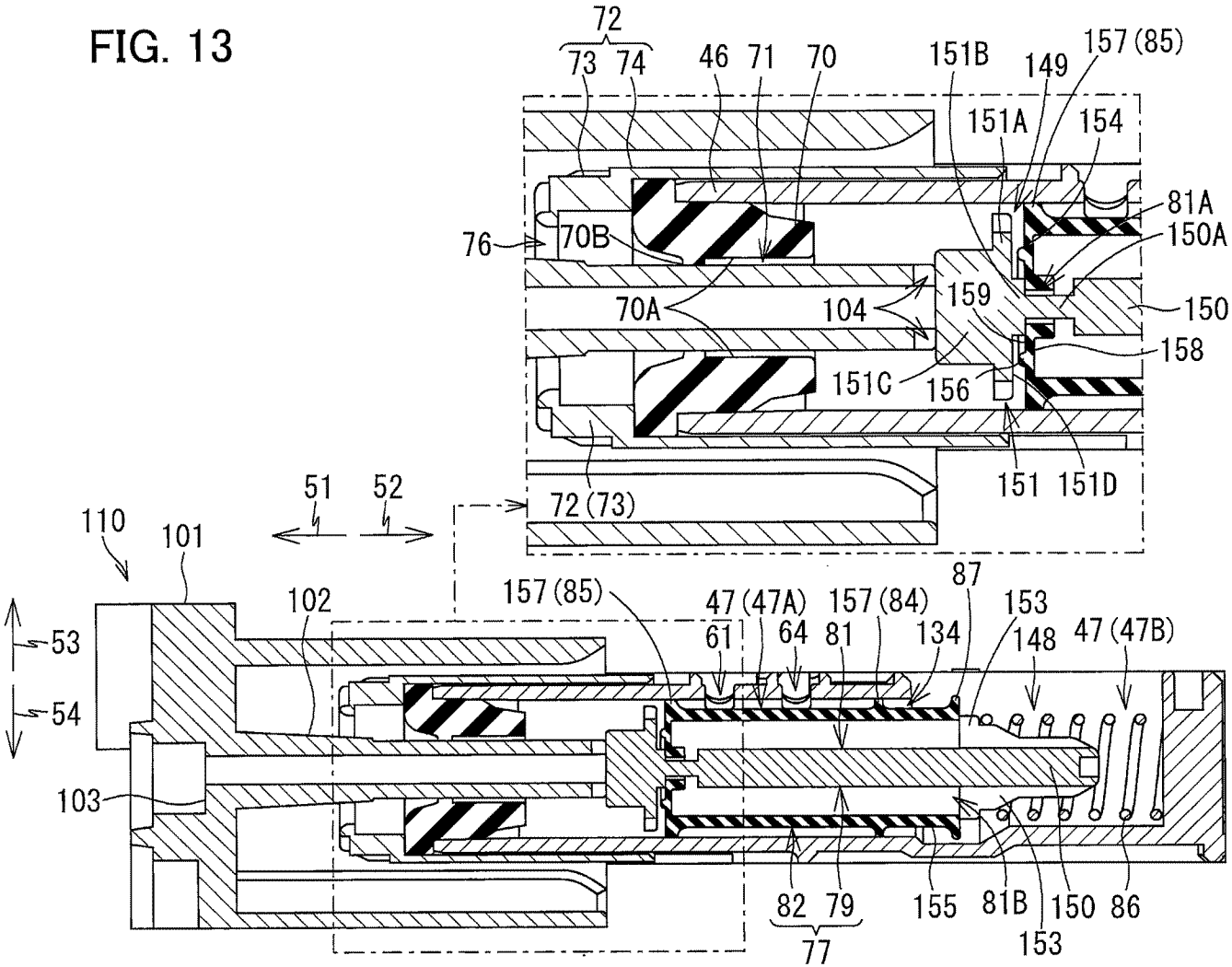
FIG. 13 is a cross-sectional view of the ink cartridge 30 according to the first embodiment taken along a plane corresponding to the plane B-B shown in FIG. 9A when a prescribed period of time has elapsed since the valve 77 reached the second state.

As shown in FIG. 13, when the ink needle 102 is inserted into the cylindrical wall 46 far enough for the communication holes 104 to be positioned inside the cylindrical wall 46, ink in an ink chamber 36 (described later) can flow through a valve chamber 47 (described later) formed inside the cylindrical wall 46 and into the ink tube 20 connected to the ink needle 102. Note that the definition of "needle" in this specification is a generic term that should include the meaning of a narrow tube-like member and need not be a member with a pointed tip at the downstream end in the removing direction 52.

It should be noted there that the distal end of the ink needle 102 (downstream end in the removing direction 52) and the communication holes 104 should define a distance therebetween in the mounting and removing directions 51 and 52 that is shorter than a distance in the mounting and removing directions 51 and 52 between a sealing part 84 and an opening 64 described later when a valve 77 described later is in a first state (the state shown in FIG. 10). Also, this distance between the distal end of the ink needle 102 (downstream end in the removing direction 52) and the communication holes 104 in the mounting and removing directions 51 and 52 is shorter than a distance in the mounting and removing directions 51 and 52 between a sealing part 85 and an opening 61 described later when the valve 77 is in the first state. In the first embodiment, this distance between the distal end of the ink needle 102 (downstream end in the removing direction 52) and the communication holes 104 in the mounting and removing directions 51 and 52 is substantially zero, since the communication holes 104 are formed in the very distal end of the ink needle 102.

[Ink Cartridge 30]

Figure 3:
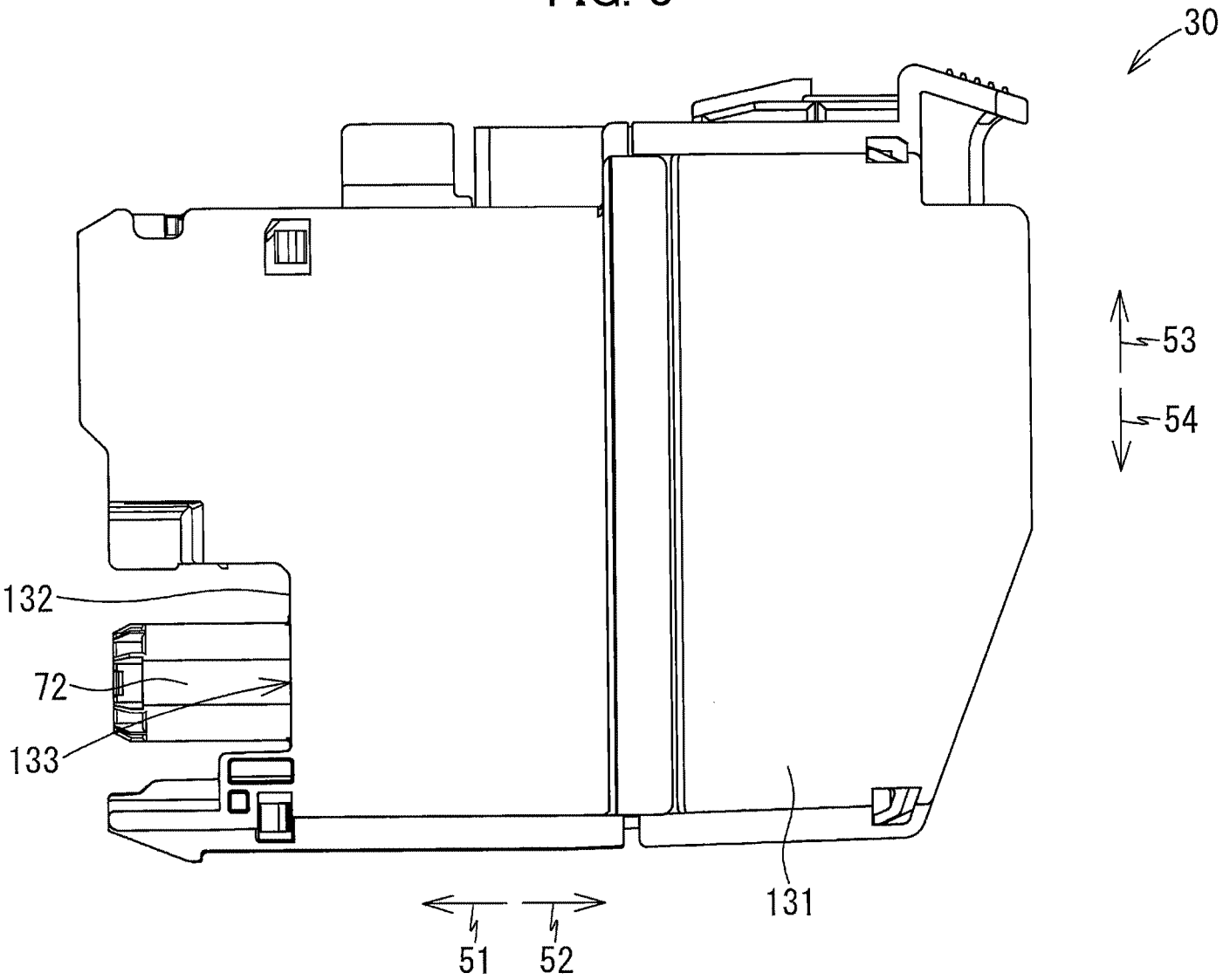
FIG. 3 is a right side view showing an external appearance of the ink cartridge 30 according to the first embodiment.
Figure 4:
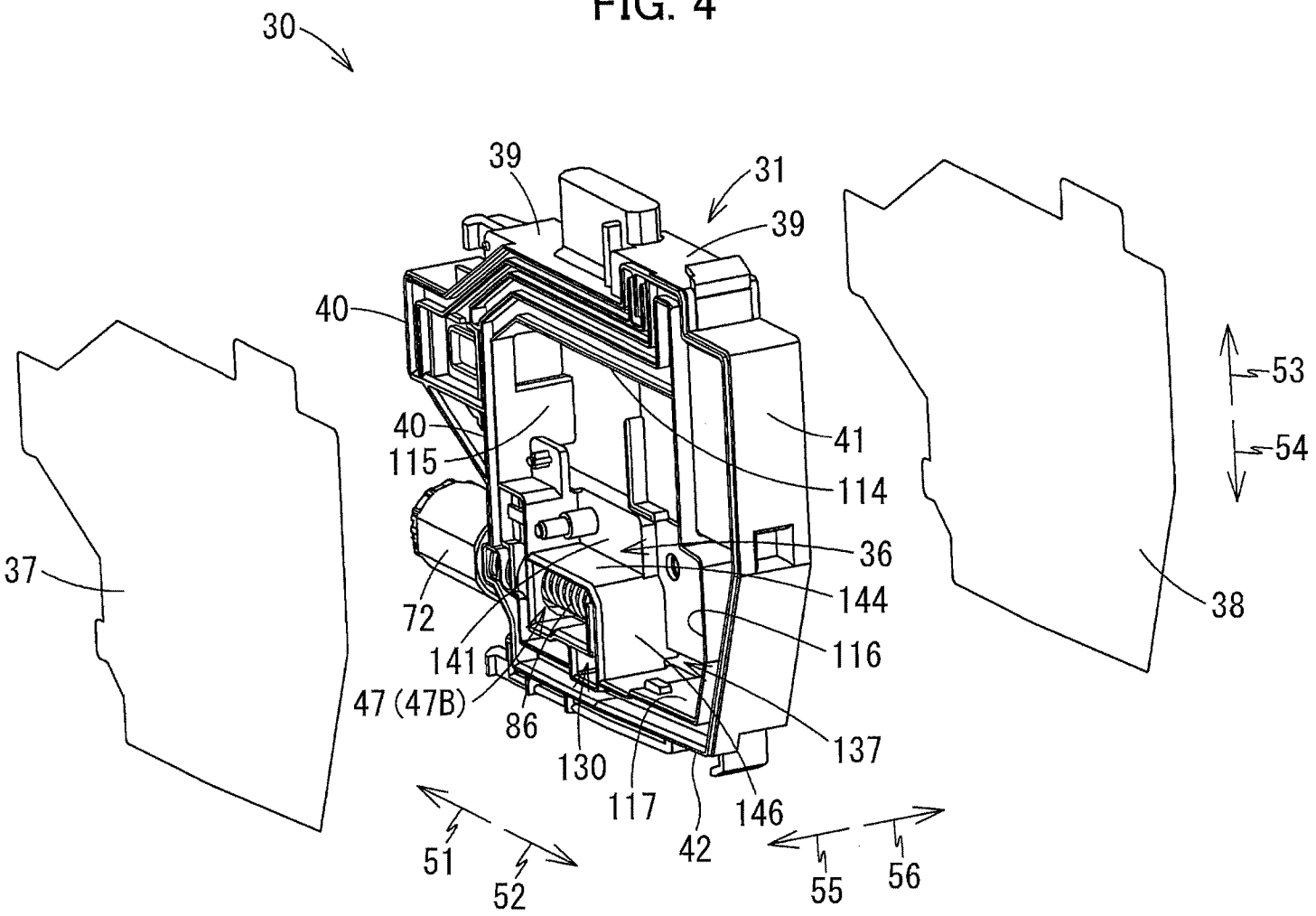
FIG. 4 is an exploded perspective view showing a structure of the ink cartridge 30 according to the first embodiment without a cartridge cover 131.

As shown in FIGS. 3 and 4, the ink cartridge 30 includes a frame 31, and a cartridge cover 131 that covers the frame 31. Inside the frame 31 formed are the ink chamber 36 (an example of a liquid chamber), the valve chamber 47 (an example of a valve chamber), and a communication path 130 (an example of a communication path). The cartridge cover 131 shown in FIG. 3 is configured of two members that can be fitted together. The two members constituting the cartridge cover 131 cover the frame 31 with the frame 31 sandwiched therebetween. Note that the cartridge cover 131 has been omitted from FIGS. 1, 4-6, and 9A. As shown FIG. 3, the cartridge cover 131 has a front wall 132 in which an opening 133 is formed. A cap 72, which is mounted on a tip end of the cylindrical wall 46 (see FIG. 5) constituting part of the frame 31, protrudes out through the opening 133.

When the ink cartridge 30 has been mounted in the cartridge-receiving section 110, ink stored in the ink chamber 36 can be supplied to the exterior of the ink cartridge 30 through the opening 133 and valve chamber 47. The ink cartridge 30 is inserted into and extracted from the cartridge-receiving section 110 in an upright state shown in FIG. 3.

[Frame 31]

As shown in FIG. 4, the frame 31 has an external shape similar to a rectangular parallelepiped that appears flattened in the rightward and leftward directions 55 and 56. Thus, the frame 31 has dimensions in the upward and downward directions 54 and 53 and the mounting and removing directions 51 and 52 that are greater than dimension of the frame 31 in the rightward and leftward directions 55 and 56. The frame 31 is formed of a resin material and has been integrally molded. In other words, the frame 31 is a resin-molded product.

The frame 31 is configured of a front wall 40, a rear wall 41, a top wall 39 and a bottom wall 42. The front wall 40 and rear wall 41 at least partially overlap each other when viewing the ink cartridge 30 in the mounting direction 51 or removing direction 52. The top wall 39 and bottom wall 42 at least partially overlap each other when viewing the ink cartridge 30 in the upward direction 54 or downward direction 53.

When the ink cartridge 30 is mounted in the cartridge-receiving section 110, the front wall 40 is oriented frontward (downstream in the mounting direction 51) and the rear wall 41 is oriented rearward (upstream in the mounting direction 51). The top wall 39 connects top edges of the front wall 40 and rear wall 41. The bottom wall 42 connects bottom edges of the front wall 40 and rear wall 41.

The frame 31 is open on its right and left sides (the sides facing in the rightward and leftward directions 55 and 56). Films 37 and 38 provide a liquid-tight seal on the respective right and left sides of the frame 31. The films 37 and 38 have been omitted from FIGS. 5, 6, and 9. The film 37 has an outer shape that substantially conforms to an outer shape of the frame 31 as viewed from the right. The film 37 is heat-sealed to right edges of the top wall 39, front wall 40, rear wall 41, and bottom wall 42. In this way, the film 37 constitutes a right wall of the ink chamber 36. The film 37 is an example of a wall member. Similarly, an outer shape of the film 38 substantially conforms to the outer shape of the frame 31 when viewed from the left. The film 38 is heat-sealed to left edges of the top wall 39, front wall 40, rear wall 41, and bottom wall 42. In this way, the film 38 constitutes a left wall of the ink chamber 36. Note that the films 37 and 38 may be affixed to the respective sides of the frame 31 through a method other than heat-sealing, such as high-frequency welding or bonding with adhesive.

The frame 31 also includes a plurality of inner walls including a top inner wall 114, a front inner wall 115, a rear inner wall 116, and a bottom inner wall 117. The top inner wall 114, front inner wall 115, rear inner wall 116, and bottom inner wall 117 are formed at positions respectively inside of the top wall 39, front wall 40, rear wall 41, and bottom wall 42 when the ink cartridge 30 is viewed in the rightward direction 55 or leftward direction 56.

Right edges of the top inner wall 114, front inner wall 115, rear inner wall 116, and bottom inner wall 117 are at the same position as the right edges of the top wall 39, front wall 40, rear wall 41, and bottom wall 42 in the rightward and leftward directions 55 and 56. Hence, the film 37 is heat-sealed to the right edges of the top inner wall 114, front inner wall 115, rear inner wall 116, and bottom inner wall 117 when being heat-sealed to the right edges of the top wall 39, front wall 40, rear wall 41, and bottom wall 42. Similarly, left edges of the bottom portion of the rear inner wall 116 and the bottom inner wall 117 are at the same position as the left edges of the top wall 39, front wall 40, rear wall 41, and bottom wall 42 in the rightward and leftward directions 55 and 56. Hence, the film 38 is heat-sealed to the left edges of the bottom portion of the rear inner wall 116 and the bottom inner wall 117 when being heat-sealed to the left edges of the top wall 39, front wall 40, rear wall 41, and bottom wall 42. However, the film 38 is not affixed to left edges of the top inner wall 114, front inner wall 115, and upper portion of the rear inner wall 116.

Figure 6B:
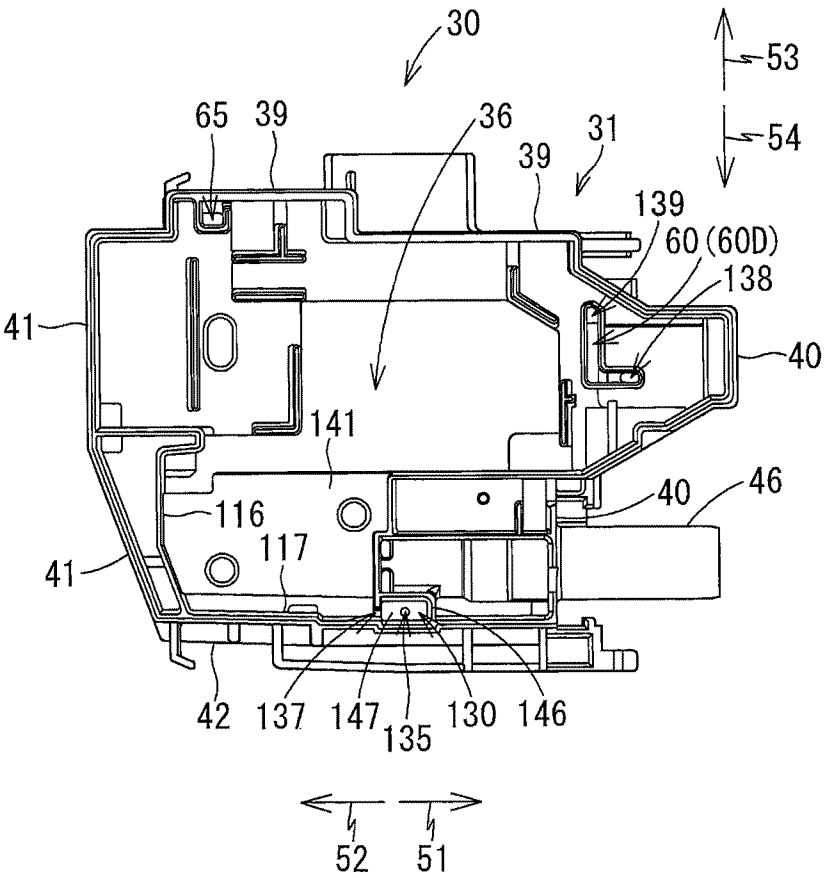
FIG. 6B is a left side view of the frame 31 of the ink cartridge 30 according to the first embodiment.
Figure 6A:
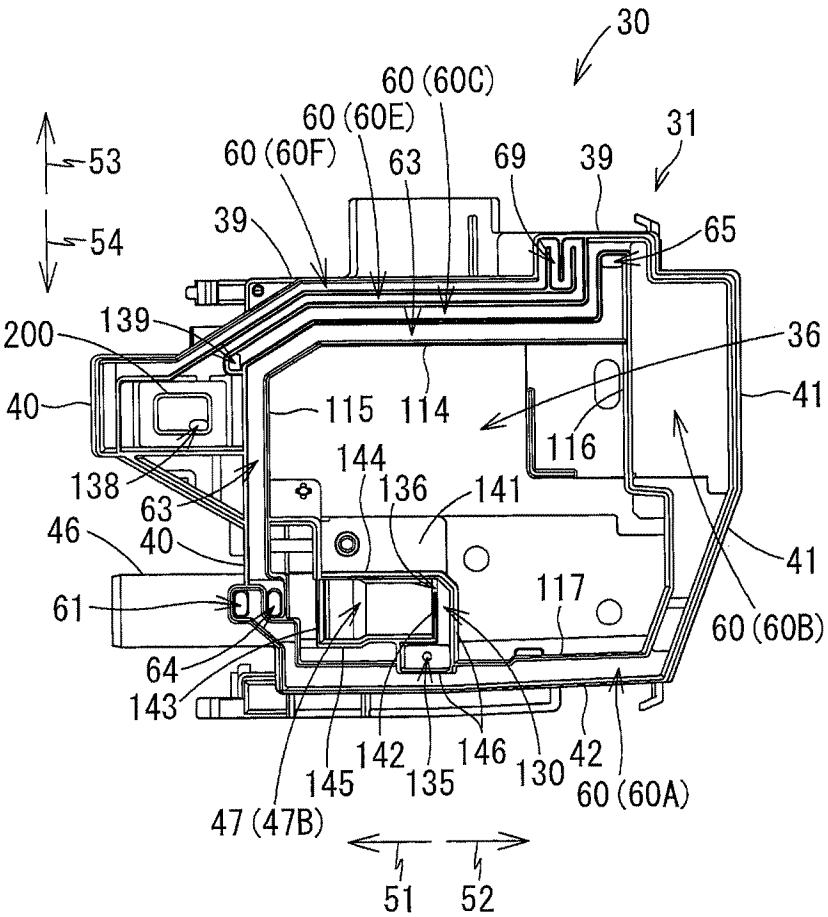
FIG. 6A is a right side view of the frame 31 of the ink cartridge 30 according to the first embodiment.

With this configuration, the ink chamber 36 in a right portion of the ink cartridge 30 is primarily formed by the top inner wall 114, front inner wall 115, rear inner wall 116, bottom inner wall 117, and film 37, as shown in FIG. 6A. However, the ink chamber 36 in a left portion of the ink cartridge 30 is primarily formed by the top wall 39, front wall 40, upper portion of the rear wall 41, lower portion of the rear inner wall 116, bottom inner wall 117, and film 38, as shown in FIG. 6B.

Further, as shown in FIGS. 5 and 6, the frame 31 includes a plurality of additional inner walls including a first inner wall 141, a second inner wall 142, a third inner wall 143, a fourth inner wall 144, a fifth inner wall 145, a sixth inner wall 146, and a seventh inner wall 147.

The first inner wall 141 extends in the mounting and removing directions 51 and 52 and the downward and upward directions 53 and 54, and is connected to the left edges of the front inner wall 115 and rear inner wall 116. The first inner wall 141 is connected to the front inner wall 115 and rear inner wall 116 in an area below the center of the ink chamber 36 in the upward and downward directions 54 and 53. The first inner wall 141 is separated from the bottom inner wall 117. That is, a gap is formed between the first inner wall 141 and bottom inner wall 117.

The second inner wall 142 extends in the downward and upward directions 53 and 54 and the rightward and leftward directions 55 and 56. The second inner wall 142 is positioned in an approximate center region of the ink chamber 36 in the mounting and removing directions 51 and 52, and protrudes in the rightward direction 55 from the first inner wall 141.

The third inner wall 143 extends in the downward and upward directions 53 and 54 and the rightward and leftward directions 55 and 56. The third inner wall 143 is positioned between the second inner wall 142 and the front inner wall 115, and protrudes in the rightward direction 55 from the first inner wall 141. The third inner wall 143 at least partially overlaps the second inner wall 142 when viewed in the mounting and removing directions 51 and 52. An opening 134 is formed in the third inner wall 143.

The fourth inner wall 144 and fifth inner wall 145 extend in the mounting and removing directions 51 and 52 and the rightward and leftward directions 55 and 56. The fourth inner wall 144 is connected to top edges of the second inner wall 142 and third inner wall 143. The fifth inner wall 145 is connected to bottom edges of the second inner wall 142 and third inner wall 143. Left edges of the fourth inner wall 144 and fifth inner wall 145 are connected to the first inner wall 141.

The sixth inner wall 146 extends from the top edge of the second inner wall 142 to an approximate center region of the fifth inner wall 145 in the mounting and removing directions 51 and 52. More specifically, the sixth inner wall 146 extends diagonally in the removing direction 52 and downward direction 53 from the top edge of the second inner wall 142, bends and extends in the mounting direction 51, bends and extends in the upward direction 54, and is connected to the bottom of the fifth inner wall 145 in the approximate center region thereof. Note that a portion of the sixth inner wall 146 extends farther leftward than the first inner wall 141 and forms an annular shape in a left side view (see FIG. 6B). Further, a portion of the sixth inner wall 146 extends lower than the bottom inner wall 117, dividing the bottom inner wall 117 in the mounting and removing directions 51 and 52.

As shown in FIG. 6, the seventh inner wall 147 extends in the mounting and removing directions 51 and 52 and the downward and upward directions 53 and 54. The seventh inner wall 147 has peripheral edges connected to the portion of the sixth inner wall 146 forming the annular shape. An opening 135 is formed in the seventh inner wall 147.

As shown in FIG. 5, the right edges of the second inner wall 142 and sixth inner wall 146 are at the same position as the right edges of the top wall 39, front wall 40, rear wall 41, and bottom wall 42 in the rightward and leftward directions 55 and 56. Therefore, the film 37 is also heat-sealed to the right edges of the second inner wall 142 and sixth inner wall 146 when being heat-sealed to the right edges of the top wall 39, front wall 40, rear wall 41, and bottom wall 42.

The heat-sealing described above forms a second valve chamber 47B, as a portion of the valve chamber 47. The second valve chamber 47B is defined by the first inner wall 141, second inner wall 142, third inner wall 143, fourth inner wall 144, fifth inner wall 145 (portions of the frame 31), and film 37 (a separate member from the frame 31). Specifically, the second valve chamber 47B is defined by wall surfaces of the first through fifth inner walls 141-145, and film 37. The second inner wall 142 has a surface 142A facing the second valve chamber 47B (see FIG. 5B). This surface 142A is an example of a base wall surface.

In other words, the frame 31 includes the wall surfaces of the first through fifth inner walls 141-145 defining the second valve chamber 47B so as to form an aperture 66 in the second valve chamber 47B that faces in the rightward direction 55 orthogonal to the mounting and removing directions 51 and 52. That is the aperture 66 is open rightward. The rightward direction 55 is an example of a third direction. The aperture 66 is closed when the film 37 is heat-sealed to the right edges of the second through fifth inner walls 142-145. Hence, the film 37 defines the second valve chamber 47B with the aperture 66 in a closed state.

The wall surfaces of the first through fifth inner walls 141-145 and film 37 that face the second valve chamber 47B are examples of wall surfaces. Of these wall surfaces defining the second valve chamber 47, the wall surfaces of the first inner wall 141, fourth inner wall 144, fifth inner wall 145, and film 37 that face the second valve chamber 47B are examples of a peripheral wall surface and extend in the mounting direction 51 from the surface 142A. Further, the wall surfaces of the first inner wall 141, fourth inner wall 144, fifth inner wall 145, and film 37 that face the second valve chamber 47B define a rectangular-shaped cross section taken along a plane orthogonal to the mounting direction 51. Note that this rectangular shape is merely an example of an annular shape. That is, the annular shape of the disclosure is not limited to a rectangular shape, but may be circular or elliptical, for example.

Also through the heat-sealing described above, the communication path 130 is formed by the first inner wall 141, second inner wall 142, fifth inner wall 145, sixth inner wall 146, seventh inner wall 147, film 37, and film 38, as illustrated in FIGS. 5 and 6. In other words, the communication path 130 is defined by wall surfaces of the first inner wall 141, second inner wall 142, fifth inner wall 145, sixth inner wall 146, seventh inner wall 147, the film 37, and the film 38.

The ink chamber 36 is in communication with the second valve chamber 47B through the communication path 130. That is, the communication path 130 extends from the ink chamber 36 to the second valve chamber 47B.

Figure 5B:
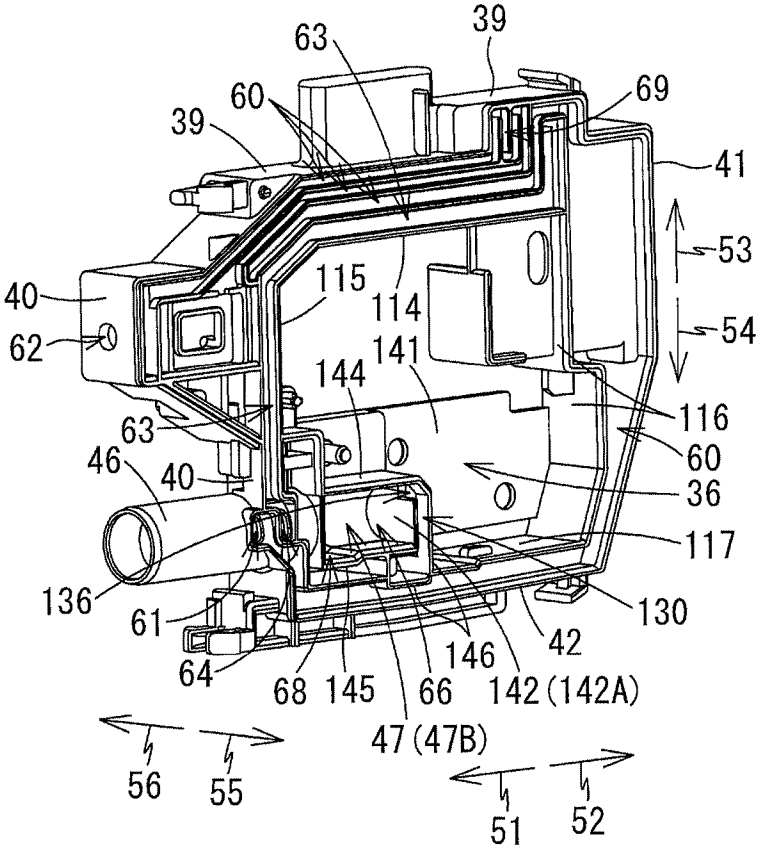
FIG. 5B is a perspective view showing the structure of the frame 31 of the ink cartridge 30 according to the first embodiment as viewed from its front and right side.

The communication path 130 communicates with the second valve chamber 47B through an opening 136 (an example of a fourth opening, see FIG. 5B). The opening 136 is a notched part formed in the second inner wall 142 defining the second valve chamber 47B, and is defined by the second inner wall 142, fourth inner wall 144, and film 37.

Further, the communication path 130 is in communication with the lower portion of the ink chamber 36 through the opening 135 (see FIG. 6) and an opening 137 (an example of a third opening, see FIG. 6B). The opening 135 is formed in the seventh inner wall 147, as described earlier. The opening 137 is formed as a notch in the annular shaped portion of the sixth inner wall 146, as illustrated in FIG. 6B, and is defined by the sixth inner wall 146 and the film 38. More specifically, the opening 137 is in communication with the lower portion of the ink chamber 36 defined by the bottom inner wall 117. In other words, the opening 137 is formed in a portion of the sixth inner wall 146 defining the bottom region of the ink chamber 36.

Note that the bottom portion of the ink chamber 36 is positioned lower than the valve chamber 47 when the ink cartridge 30 is in the operational state. Further, the communication path 130 may be in communication with a first valve chamber 47A (described later) constituting part of the valve chamber 47, rather than the second valve chamber 47B.

As shown in FIGS. 5 and 6, the frame 31 includes the cylindrical wall 46. The cylindrical wall 46 extends in the mounting direction 51 from the third inner wall 143 to a position outside of the ink cartridge 30. The cylindrical wall 46 has a downstream end in the mounting direction 51 (tip end) that protrudes out of the front wall 40, while a downstream end of the cylindrical wall 46 in the removing direction 52 (base end) is positioned between the front wall 40 and rear wall 41. The downstream end of the cylindrical wall 46 in the mounting direction 51 is open. The downstream end of the cylindrical wall 46 in the removing direction 52 is also open, and this opening constitutes the opening 134 formed in the third inner wall 143.

The cylindrical wall 46 has an inner circumferential surface that extends continuously in a cross section taken along a plane orthogonal to the mounting direction 51. In other words, the inner circumferential surface of the cylindrical wall 46 has an annular-shaped cross section. Thus, the inner circumferential surface of the cylindrical wall 46 appears annular when viewed in the mounting direction 51. The inner circumferential surface of the cylindrical wall 46 is an example of a peripheral wall surface. Note that this annular shape is not limited to a circular shape, but may be elliptical or rectangular, for example. In other words, while the inner circumferential surface of the cylindrical wall 46 has a circular annular shape when viewed in the mounting direction 51 in the first embodiment, the inner circumferential surface of the cylindrical wall 46 may have an annular shape that is not circular.

While the inner circumferential surface of the cylindrical wall 46 in the first embodiment is annular shaped when viewed in the mounting direction 51 at any cross section along its entire length from the downstream end in the mounting direction 51 to the downstream end in the removing direction 52, the cylindrical wall 46 may be formed such that only a portion of its inner circumferential surface is annular shaped when viewed in the mounting direction 51. However, the inner circumferential surface of the cylindrical wall 46 must be annular shaped when viewed in the mounting direction 51 at least in areas that contact sealing parts 84, 85, and 87 described later.

Figure 9A:
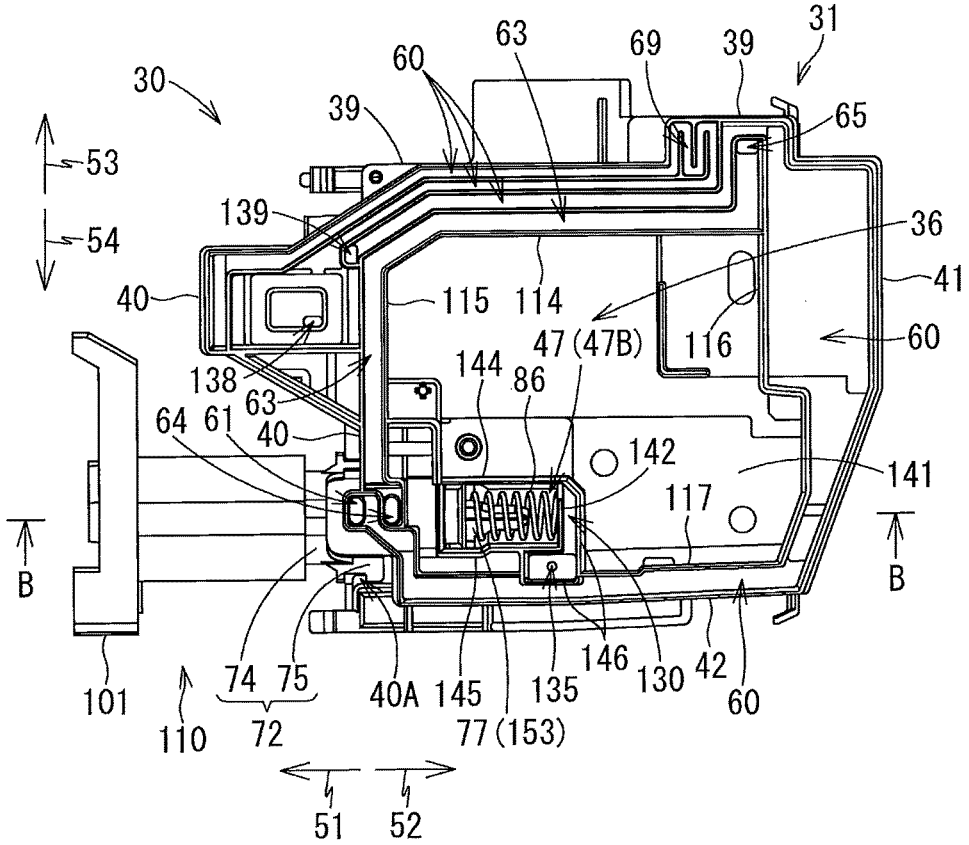
FIG. 9A is a right side view of the ink cartridge 30 according to the first embodiment received in the cartridge-receiving section 110, wherein the cartridge cover 131 and films 37 and 38 are omitted.
Figure 9B:
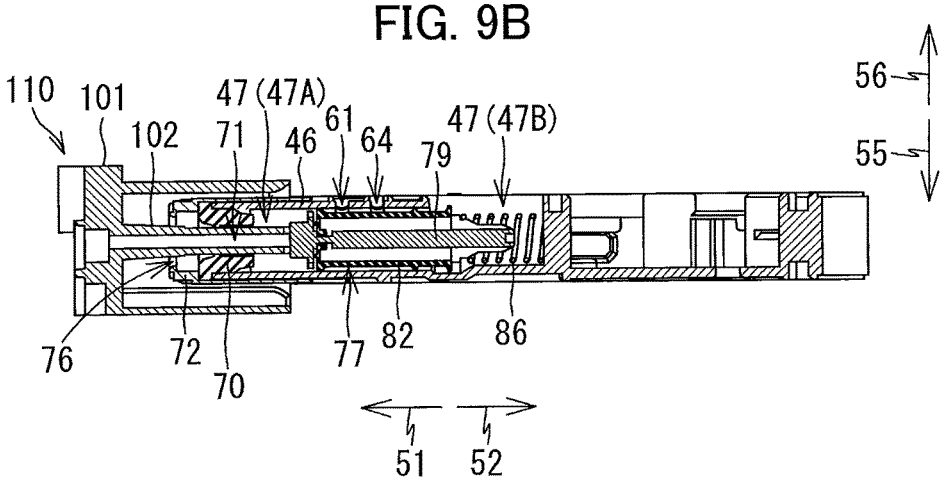
FIG. 9B is a cross-sectional view of the ink cartridge 30 according to the first embodiment received in the cartridge-receiving section 110 taken along a plane B-B shown in FIG. 9A.

As shown in FIG. 9B, the cylindrical wall 46 has an internal space that serving as the first valve chamber 47A. Hence, the first valve chamber 47A is defined by the inner circumferential surface of the cylindrical wall 46. As shown in FIG. 10, the first valve chamber 47A has a downstream end in the mounting direction 51 that is in communication with the exterior of the ink cartridge 30 via through-holes 71 and 76 described later. The first valve chamber 47A also has a downstream end in the removing direction 52 that is in communication with the second valve chamber 47B through the opening 134 formed in the third inner wall 143. Hence, the second valve chamber 47B is positioned on the downstream side of the first valve chamber 47A in the removing direction 52 and is in communication with the first valve chamber 47A.

Together, the first valve chamber 47A and second valve chamber 47B constitute the valve chamber 47. Thus, the wall surfaces defining the valve chamber 47 include at least the surface 142A of the second inner wall 142 and the inner circumferential surface of the cylindrical wall 46.

The second valve chamber 47B has a dimension in a direction orthogonal to the mounting and removing directions 51 and 52 that is greater than an inner diameter of the cylindrical wall 46 (dimension of the first valve chamber 47A in a direction orthogonal to the mounting and removing directions 51 and 52). This is due to the structure of the downstream end of the second valve chamber 47B in the mounting direction 51.

Specifically, the walls and the film 37 that define downstream end of the second valve chamber 47B in the mounting direction 51 are configured as described below.

Figure 5A:
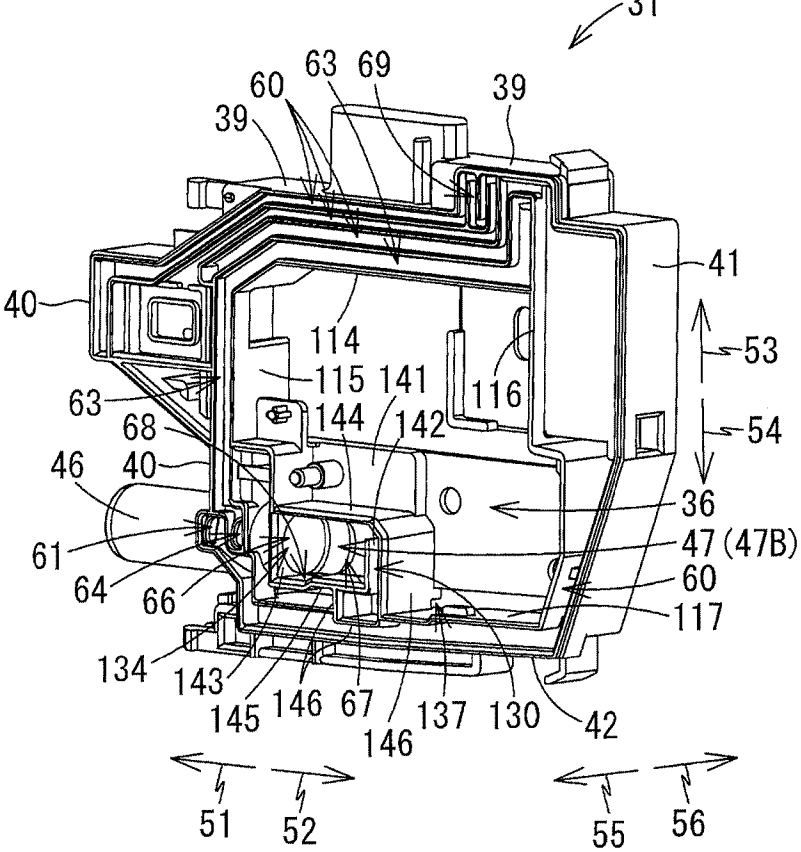
FIG. 5A is a perspective view showing a structure of a frame 31 of the ink cartridge 30 according to the first embodiment as viewed from its rear and right side.

As illustrated in FIG. 5A, a recessed part 67 is formed in a portion of the first inner wall 141 defining the downstream end of the second valve chamber 47B in the mounting direction 51. The recessed part 67 is recessed in the leftward direction 56. The recessed part 67 extends from the top edge to the bottom edge of the second valve chamber 47B. Additionally, a recessed part 68 is formed in a portion of the fifth inner wall 145 defining the downstream end of the second valve chamber 47B in the mounting direction 51. The recessed part 68 is recessed in the downward direction 53. The recessed part 68 extends from the left edge to the right edge of the second valve chamber 47B. The recessed part 68 has a left edge that is formed continuously with the bottom edge of the recessed part 67. The surface of the fourth inner wall 144 facing the second valve chamber 47B is positioned higher than the upper portion of the inner circumferential surface of the cylindrical wall 46. The film 37 is positioned rightward of the right end of the inner circumferential surface of the cylindrical wall 46.

A liquid channel and an air channel are formed in the frame 31.

As shown in FIG. 9, the liquid channel extends from the ink chamber 36 to the through-hole 71 (described later). Ink primarily flows through the liquid channel. The liquid channel passes through the communication path 130 and valve chamber 47. The liquid channel has one end in communication with the ink chamber 36 via the opening 137 (see FIG. 6B), and another end in communication with the exterior of the ink cartridge 30 through the through-hole 71.

As shown in FIG. 6, the air channel extends from the ink chamber 36 to the exterior of the ink cartridge 30. Air primarily flows through the air channel. The air channel passes through a first air channel 60 described later, the valve chamber 47 (the first valve chamber 47A shown in FIG. 9B in the first embodiment), and a second air channel 63 described later. In other words, the air channel includes the first air channel 60 and second air channel 63. One end of the air channel is in communication with the ink chamber 36 via an opening 65 described later, while the other end is in communication with the exterior of the ink cartridge 30 via an opening 62 described later (see FIG. 5B).

[Valve Chamber 47]

As described above, the valve chamber 47 is a space defined by wall surfaces of a plurality of inner walls in the frame 31 and the film 37. As shown in FIG. 1, the valve chamber 47 is disposed in a lower-front portion of the ink cartridge 30.

As shown in FIG. 9, the first air channel 60, the second air channel 63, and the communication path 130 are connected to the valve chamber 47. A sealing member 70 and the cap 72 are mounted on the tip end of the cylindrical wall 46 (the downstream end of the cylindrical wall 46 in the mounting direction 51). The valve 77 and a coil spring 86 are accommodated inside the cylindrical wall 46.

[First Air Channel 60]

As shown in FIG. 6A, the first air channel 60 allows air to flow between the valve chamber 47 (the first valve chamber 47A in the first embodiment) and the exterior of the ink cartridge 30. Thus, the first air channel 60 allows the valve chamber 47 to communicate with the atmosphere.

As shown in FIG. 6, the first air channel 60 is configured of a groove 60A, a buffer chamber 60B, a groove 60C, a groove 60D, a groove 60E, and a groove 60F. As shown in FIG. 6A, the groove 60A, buffer chamber 60B, groove 60C, groove 60E, and groove 60F are all open on the side facing in the rightward direction 55, but are sealed liquid-tight by the film 37. The groove 60D is open on the side facing in the leftward direction 56, as shown in FIG. 6B, but is sealed liquid tight by the film 38.

As shown in FIG. 6A, the groove 60A extends in the removing direction 52 along the top surface of the bottom wall 42. One end of the groove 60A is in communication with the first valve chamber 47A via the opening 61 formed in the inner circumferential surface of the cylindrical wall 46, while the other end of the groove 60A is in communication with the buffer chamber 60B. The opening 61 is an example of a first opening.

The buffer chamber 60B is a space that is wider than the grooves constituting the first air channel 60. The buffer chamber 60B stores ink flowing through the groove 60A from the valve chamber 47, thereby reducing the amount of ink that flows through the buffer chamber 60B into the groove 60C. One end of the buffer chamber 60B is in communication with the groove 60A, while the other end is in communication with the groove 60C.

The grooves 60C, 60E, and 60F extend in the mounting and removing directions 51 and 52 and are arranged adjacent to each other between the top inner wall 114 and the top wall 39.

One end of the groove 60C is in communication with the buffer chamber 60B, while the other end is in communication with the groove 60D (see FIG. 6B) through an opening 139. As shown in FIG. 6B, one end of the groove 60D is in communication with the groove 60C via the opening 139, while the other end of the groove 60D is in communication with the groove 60E via an opening 138. As shown in FIG. 6A, one end of the groove 60E is in communication with the groove 60D via the opening 138, while the other end is in communication with the groove 60F. One end of the groove 60F is in communication with the groove 60E, while the other end is in communication with the exterior of the ink cartridge 30 via the opening 62 formed in the front wall 40 (see FIG. 5B).

The opening 138 is surrounded by an annular rib 200 protruding in the rightward direction 55, as shown in FIG. 6A. A semipermeable membrane (not shown) is affixed to a peripheral edge (right edge) of the annular rib 200. The semipermeable membrane is a porous membrane having micropores that allow passage of air while preventing passage of ink. For example, the semipermeable membrane may be formed of a fluoropolymer, such as polytetrafluoroethylene, polychlorotrifluoroethylene, tetrafluoroethylenehexafluoropropylene copolymer, tetrafluoroethylene-perfluoroalkyl vinyl ether copolymer, or tetrafluoroethylene-ethylene copolymer.

As shown in FIG. 6A, a labyrinthine structure 69 is provided at a bordering region between the groove 60E and groove 60F.

[Second Air Channel 63]

As shown in FIG. 6A, the second air channel 63 allows air to flow between the valve chamber 47 (the first valve chamber 47A in the first embodiment) and the ink chamber 36. The second air channel 63 extends in the upward direction 54 from the first valve chamber 47A adjacent to the groove 60E and then extends in the removing direction 52 adjacent to the groove 60C. One end of the second air channel 63 is in communication with the first valve chamber 47A (see FIG. 9) through an opening 64 formed in the inner circumferential surface of the cylindrical wall 46. The other end of the second air channel 63 is in communication with an upper portion of the ink chamber 36 through the opening 65. The opening 64 is an example of a second opening.

The opening 64 is formed at a position offset from the opening 61 in the removing direction 52. The opening 65 is formed at a position higher than a level of ink accommodated in the ink chamber 36 when the ink cartridge 30 in an unused state (the state of a new ink cartridge before any ink has been expended) is in its operational state.

[Sealing Member 70]

As shown in FIG. 7, the sealing member 70 mounted in the cylindrical wall 46 has a general disc shape. As shown in FIG. 10, the sealing member 70 has an outer diameter that is substantially equivalent to the inner diameter of the cylindrical wall 46. The sealing member 70 is tightly fitted into the tip end of the cylindrical wall 46, forming a liquid-tight seal. The sealing member 70 is formed of a rubber or other elastic material, for example.

Figure 10:
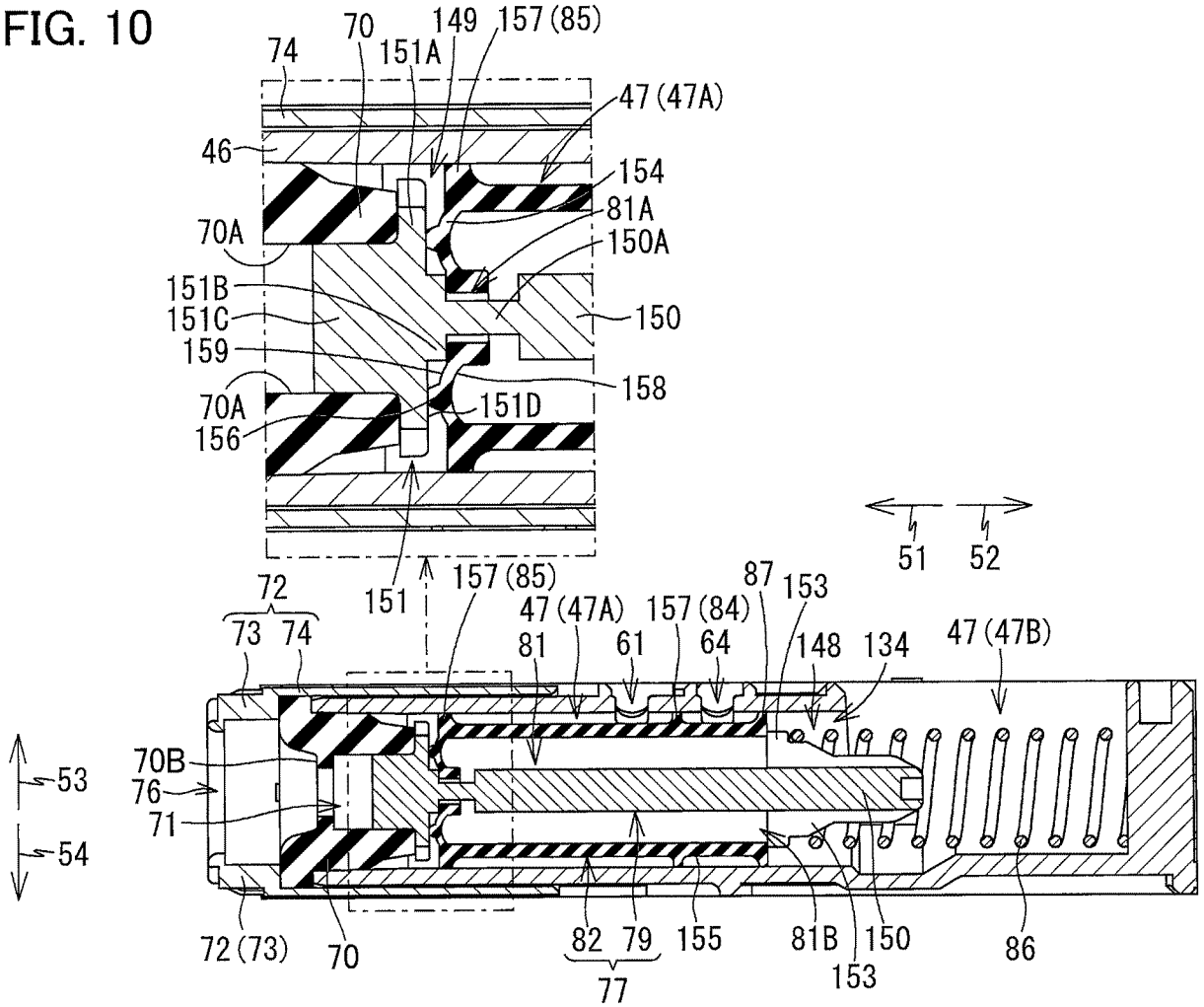
FIG. 10 is a cross-sectional view of the ink cartridge 30 according to the first embodiment taken along a plane corresponding to the plane B-B shown in FIG. 9A, wherein the valve 77 is in its first state.

As shown in FIGS. 7 and 10, the through-hole 71 is formed in the sealing member 70 and penetrates a center region of the sealing member 70 in its thickness dimension (in the mounting and removing directions 51 and 52). The through-hole 71 provides communication between the first valve chamber 47A and the exterior of the ink cartridge 30 and allows ink stored in the ink chamber 36 to flow.

The sealing member 70 has an inner circumferential surface 70A (see FIG. 10, as an example of a peripheral surface) that defines the through-hole 71. An annular rib 70B is formed on the inner circumferential surface 70A. The outer diameter of the ink needle 102 is slightly larger than an inner diameter of the annular rib 70B and slightly smaller than an inner diameter of the through-hole 71. Accordingly, when the ink needle 102 is inserted into the through-hole 71 as will be described later, the outer circumferential surface of the ink needle 102 forms a liquid-tight seal with the annular rib 70B.

[Cap 72]

Figure 7B:
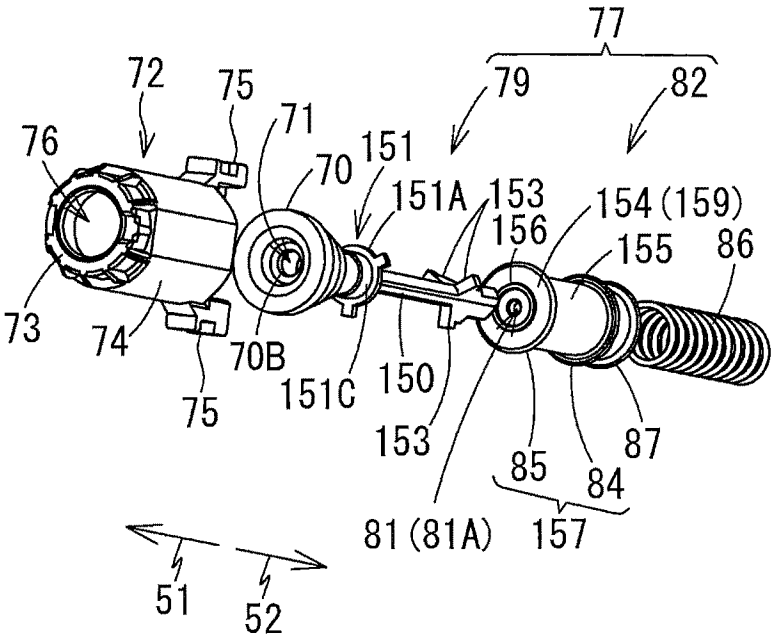
FIG. 7B is an exploded perspective view of the components required for opening and closing the valve chamber 47 of the ink cartridge 30 according to the first embodiment as viewed from diagonally frontward thereof.

As shown in FIG. 7, the cap 72 mounted on the cylindrical wall 46 is configured of a disc-shaped cover part 73, a cylindrical part 74, and engaging parts 75. The cylindrical part 74 protrudes from a side surface of the cover part 73 facing in the removing direction 52. The engaging parts 75 protrude in the removing direction 52 from a protruding end of the cylindrical part 74. As shown in FIG. 7B, a through-hole 76 is formed in the cover part 73 and penetrates a center region of the cover part 73 in its thickness dimension (in the mounting and removing directions 51 and 52). The through-hole 76 has a diameter larger than that of the through-hole 71. The cylindrical part 74 is provided to surround the through-hole 76. The cap 72 is formed of a resin material, for example.

The cover part 73 contacts the sealing member 70 on the side of the sealing member 70 opposite the cylindrical wall 46. Hence, the sealing member 70 is interposed between the cover part 73 and the tip end of the cylindrical wall 46 in the mounting and removing directions 51 and 52. As shown in FIG. 10, the cylindrical part 74 covers the outer circumferential surface of the sealing member 70 and a portion on the outer circumferential surface of the cylindrical wall 46. The engaging parts 75 engage with engagement parts 40A provided on the front wall 40 (see FIG. 9A). The cap 72 holds the sealing member 70 on the tip end of the cylindrical wall 46.

[Valve 77]

As shown in FIGS. 9 and 10, the valve 77 is disposed in the valve chamber 47. In the first embodiment, a majority of the valve 77 is disposed in the first valve chamber 47A, while only a portion of the valve 77 (downstream end thereof in the removing direction 52) is disposed in the second valve chamber 47B. The valve 77 is capable of moving in the valve chamber 47 in the mounting and removing directions 51 and 52.

As shown in FIGS. 7 and 8, the valve 77 includes a retaining part 79, and a cylindrical elastic member 82. A through-hole 81 is formed in the elastic member 82 and penetrates the elastic member 82 in the mounting and removing directions 51 and 52. Part of the retaining part 79 (a body portion 150 described later) is inserted into the through-hole 81. The retaining part 79 is formed of a resin material, for example. The elastic member 82 is formed of an elastic material such as rubber that has a lower rigidity than the retaining part 79.

The retaining part 79 includes the body portion 150, a columnar portion 151 (an example of a closing part; and a first closing part), and anchoring parts 153. The body portion 150 has a general rod-like shape that extends in the mounting and removing directions 51 and 52. The columnar portion 151 is provided on an end 150A of the body portion 150 positioned downstream in the mounting direction 51 (see FIG. 10). The anchoring parts 153 are provided on a downstream end of the body portion 150 in the removing direction 52.

As shown in FIGS. 7 and 8, the elastic member 82 is configured of an end wall 154 (an example of a third closing part, and an example of an end wall), a cylindrical wall 155 that extends in the removing direction 52 from the end wall 154, an air channel closing part 157 (as an example of a second closing part) having two sealing parts 84 and 85, and a sealing part 87. The end wall 154, cylindrical wall 155, air channel closing part 157, and sealing part 87 are configured as a single integral unit.

As shown in FIG. 10, the end wall 154 constitutes a downstream end of the elastic member 82 in the mounting direction 51. The end wall 154 is formed with an opening 81A to penetrate a center portion of the end wall 154 in the mounting direction 51. The cylindrical wall 155 defines the through-hole 81 therein. That is, the opening 81A constitutes a downstream end of the through-hole 81 in the mounting direction 51. The cylindrical wall 155 has a downstream end in the removing direction 52 in which an opening 81B is formed. That is, the opening 81B constitutes a downstream end of the through-hole 81 in the removing direction 52.

As shown in FIGS. 7 and 8, the sealing parts 84, 85, and 87 are flanges that protrude radially outward from an outer circumferential surface of the cylindrical wall 155. The sealing parts 84, 85, and 87 are examples of a first sealing part, a second sealing part and a third sealing part, respectively. Details of the sealing parts 84, 85 and 87 will be described later.

Now, the retaining part 79 and the elastic member 82 will be described more in detail.

As shown in FIG. 10, the body portion 150 of the retaining part 79 is inserted into the through-hole 81 of the elastic member 82. The body portion 150 has a diameter smaller than an inner diameter of the through-hole 81. Consequently, gaps are formed between the body portion 150 and an inner circumferential surface defining the through-hole 81 formed in the cylindrical wall 155 of the elastic member 82. These gaps allow the flow of ink stored in the ink chamber 36. That is, when passing through the valve chamber 47, the liquid channel passes the gaps formed between the elastic member 82 and retaining part 79 within the through-hole 81. In other words, the liquid channel extends from the ink chamber 36 to the through-hole 71 via the through-hole 81.

The end 150A of the body portion 150 has a smaller diameter than a diameter of a remaining portion of the body portion 150. The end 150A of the body portion 150 is inserted into the opening 81A formed in the end wall 154 of the elastic member 82. Note that the diameter of the end 150A of the body portion 150 is smaller than an inner diameter of the opening 81A.

Figure 8B:
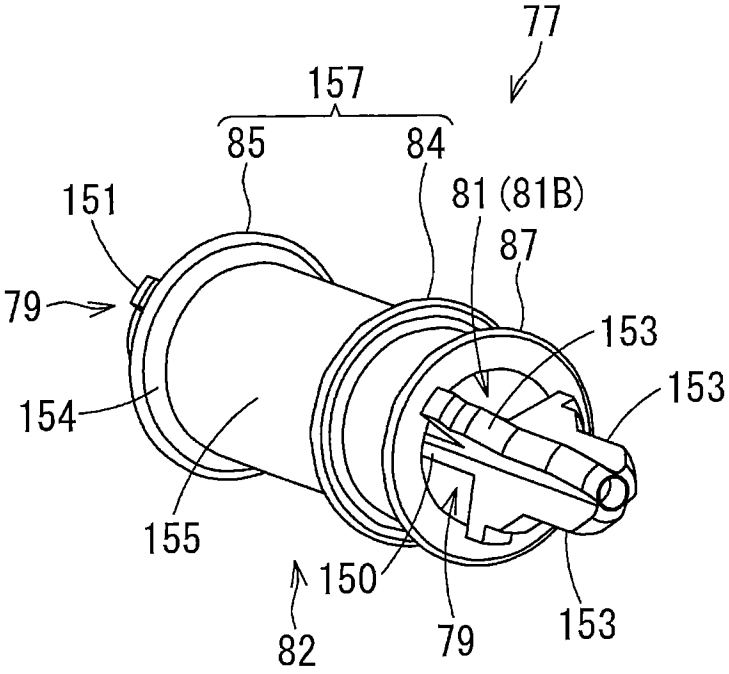
FIG. 8B is a perspective view showing the external appearance of the valve 77 the ink cartridge 30 according to the first embodiment as viewed from diagonally rearward thereof.
Figure 8A:
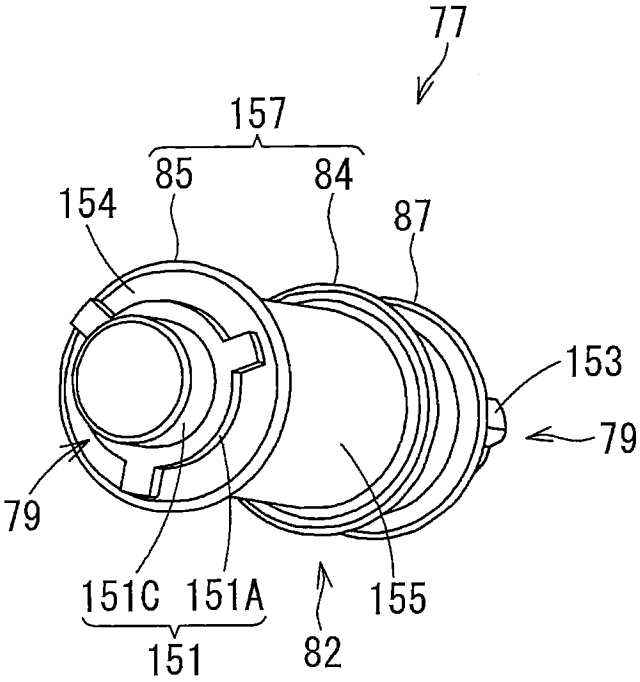
FIG. 8A is a perspective view showing an external appearance of a valve 77 the ink cartridge 30 according to the first embodiment as viewed from diagonally frontward thereof.

As shown in FIGS. 8A and 10, when the body portion 150 has been inserted into the through-hole 81 of the elastic member 82, the columnar portion 151 is positioned downstream of the elastic member 82 in the mounting direction 51. Or, the columnar portion 151 protrudes out from the elastic member 82 in the mounting direction 51. Specifically, the columnar portion 151 includes a disc part 151A, contact parts 151B (see FIG. 10), and a protruding part 151C (an example of a liquid-outlet sealing part).

Figure 7A:
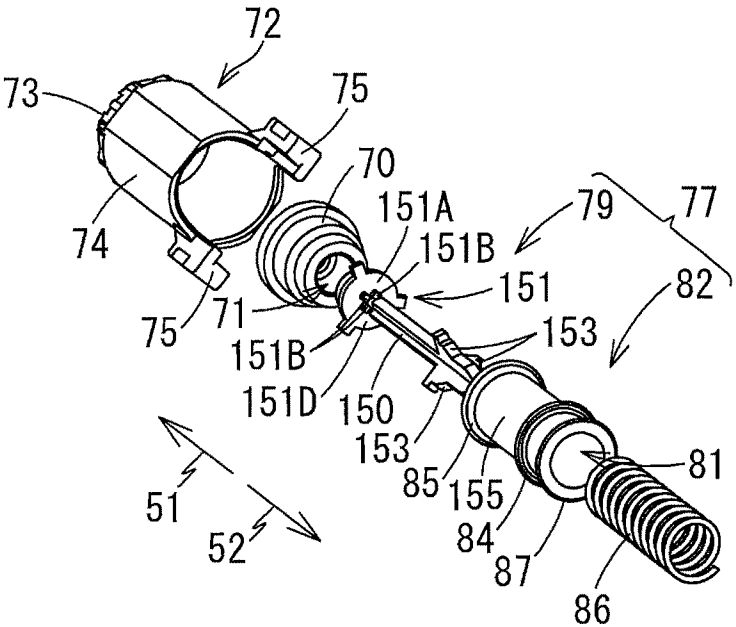
FIG. 7A is an exploded perspective view of components required for opening and closing a valve chamber 47 of the ink cartridge 30 according to the first embodiment as viewed from diagonally rearward thereof.

As shown in FIG. 10, the disc part 151A is disk-like shaped and has a surface 151D facing the body portion 150. This surface 151D is an example of a third surface. The contact parts 151B are formed on the surface 151D of the disc part 151A. More specifically, a plurality of the contact parts 151B (four in the first embodiment) is provided on the surface 151D of the disc part 151A at intervals in a circumferential direction of the disc part 151A. The contact parts 151B are connected to the end 150A of the body portion 150, as shown in FIG. 7A. As shown in FIG. 10, the contact parts 151B contact a peripheral region defining the opening 81A on the end wall 154 of the elastic member 82.

As shown in FIGS. 8A and 10, the protruding part 151C protrudes in the mounting direction 51 from another surface of the disc part 151A opposite the surface 151D in the mounting direction 51. The protruding part 151C is columnar-shaped and can be inserted into the through-hole 71 formed in the sealing member 70. The protruding part 151C has a diameter greater than the inner diameter of the through-hole 71. Accordingly, as the protruding part 151C is inserted into the through-hole 71, the protruding part 151C contacts the inner circumferential surface 70A of the sealing member 70 defining the through-hole 71 and causes the inner circumferential surface 70A to elastically deform. As a result, the protruding part 151C can provide a liquid-tight seal in the through-hole 71. As the valve 77 moves, the protruding part 151C slides while being in close contact with the inner circumferential surface 70A of the sealing member 70. When the valve 77 is moved in the removing direction 52 from its position shown in FIG. 10, the protruding part 151C separates from the sealing member 70 (see FIG. 13), thereby opening the through-hole 71. In this way, the protruding part 151C can open and close the through-hole 71.

As shown in FIGS. 8B and 10, the anchoring parts 153 are positioned downstream of the elastic member 82 in the removing direction 52 when the body portion 150 has been inserted into the elastic member 82. As shown in FIGS. 7 and 8B, a plurality of anchoring parts 153 (three in the first embodiment) is arranged at intervals in the circumferential direction of the body portion 150. The anchoring parts 153 protrude from the body portion 150 in directions orthogonal to the removing direction 52. As shown in FIG. 10, the anchoring parts 153 contact a peripheral region defining the opening 81B constituting the downstream end of the through-hole 81 in the removing direction 52 formed in the elastic member 82.

As described above, when the body portion 150 has been inserted into the elastic member 82, the contact parts 151B are in contact with the elastic member 82 around the periphery of the opening 81A, and the anchoring parts 153 are in contact with the elastic member 82 around the periphery of the opening 81B. Accordingly, the elastic member 82 can move within the valve chamber 47 in the mounting and removing directions 51 and 52 together with the retaining part 79.

Referring to the elastic member 82, as shown in FIGS. 7 and 8, the sealing parts 84, 85 and 87 are flanges provided on the cylindrical wall 155 of the elastic member 82. The sealing parts 84, 85 and 87 are annular shaped when viewed in the mounting direction 51. In the first embodiment, the sealing parts 84, 85 and 87 have a circular annular shape corresponding to the inner circumferential surface of the cylindrical wall 46, but these components may have a non-circular annular shape corresponding to the inner circumferential surface of the cylindrical wall 46 when the inner circumferential surface of the cylindrical wall 46 has an annular cross-section that is not circular.

The sealing parts 84, 85, and 87 are separated from each other in the mounting and removing directions 51 and 52. The sealing part 85 is disposed offset from the sealing part 84 in the mounting direction 51, and the sealing part 87 is provided offset in the removing direction 52 from the sealing part 84.

As shown in FIG. 10, the sealing parts 84, 85, and 87 form a liquid-tight and airtight seal with the inner circumferential surface of the cylindrical wall 46. Outer diameters of the sealing parts 84, 85, and 87 are greater than the inner diameter of the cylindrical wall 46 when the valve 77 is not inserted into the first valve chamber 47A (in the state shown in FIGS. 7 and 8). Accordingly, when the valve 77 is inserted into the first valve chamber 47A (the state shown in FIG. 10), the sealing parts 84, 85, and 87 elastically deform in such a direction that their outer diameters are reduced while remaining in close contact with the inner circumferential surface of the cylindrical wall 46.

As shown in FIG. 10, the close contact formed by the sealing parts 84, 85, and 87 with the inner circumferential surface of the cylindrical wall 46 isolates a first space 148 that includes the downstream end of the first valve chamber 47A in the removing direction 52 from a second space 149 that includes the downstream end of the first valve chamber 47A in the mounting direction 51 in an area formed between the outer circumferential surface of the elastic member 82 and the inner circumferential surface of the cylindrical wall 46.

On the other hand, the first space 148 and second space 149 are sections of the liquid channel, and ink can flow between the first and second spaces 148 and 149 via the through-hole 81. More specifically, when supplying ink from the ink chamber 36 to the outside of the ink cartridge 30, the ink can flow in a direction from the first space 148 to the second space 149, as shown in FIG. 13. This direction (an example of a flowing direction) is defined as an ink-supplying direction in which the ink can flow sequentially through: the spaces between the neighboring anchoring parts 153 juxtaposed in the circumferential direction of the body portion 150; the opening 81B formed in the cylindrical wall 155; the space formed in the through-hole 81 between the outer circumferential surface of the body portion 150 and the inner circumferential surface of the cylindrical wall 155; the opening 81A formed in the cylindrical wall 155; the spaces between the neighboring two contact parts 151B juxtaposed in the circumferential direction of the body portion 150; and the space between the end wall 154 and columnar portion 151. The ink-supplying direction at the opening 81A formed in the end wall 154 is coincident with the mounting direction 51.

As will be described later in greater detail, due to the close contact by the sealing parts 84, 85, and 87 with the inner circumferential surface of the cylindrical wall 46, the space between the sealing parts 84 and 85 can be a closed space so that air can flow therethrough.

When the valve 77 is in the position shown in FIG. 10, the sealing part 84 is positioned between the openings 61 and 64. Thus, the sealing part 84 blocks the space between the first air channel 60 and second air channel 63. The sealing parts 84, 85, and 87 can slide while remaining in contact with the inner circumferential surface of the cylindrical wall 46 as the valve 77 moves. When the valve 77 is moved in the removing direction 52 from its position shown in FIG. 10, the openings 61 and 64 become positioned between the sealing parts 84 and 85, as shown in FIG. 13. Consequently, the first and second air channels 60 and 63 can communicate with each other through the space between the sealing parts 84 and 85. Thus, the ink chamber 36 can communicate with the exterior of the ink cartridge 30, opening up the ink chamber 36 to the atmosphere. In other words, the air channel closing part 157 opens the air channel when the valve 77 is moved. With this configuration, the air channel closing part 157 can open and close the air channel.

The end wall 154 shown in FIGS. 7B and 8A is a flexible membranous member. As shown in FIG. 10, the end wall 154 has a first surface 158 facing in the removing direction 52, a second surface 159 facing in the mounting direction 51 on the opposite side from the first surface 158, and an annular rib 156 (see FIG. 7B) formed on the second surface 159. The first surface 158 and second surface 159 are examples of a first surface and a second surface, respectively.

The first surface 158 partially defines the space in the through-hole 81 between the body portion 150 and the inner circumferential surface of the cylindrical wall 155. The second surface 159 partially defines the space between the end wall 154 and the columnar portion 151. Here, the space in the through-hole 81 between the body portion 150 and the inner circumferential surface of the cylindrical wall 155 is positioned upstream of the space between the end wall 154 and columnar portion 151 in the ink-supplying direction.

As described above, the end wall 154 is provided in the liquid channel. Further, the first surface 158 of the end wall 154 faces upstream in the ink-supplying direction, which is the direction from the ink chamber 36 toward the through-hole 71. Further, the second surface 159 faces downstream in the ink-supplying direction.

The second surface 159 confronts the surface 151D of the columnar portion 151 constituting the retaining part 79.

As shown in FIG. 7B, the annular rib 156 protrudes in the mounting direction 51 from the second surface 159 around the circumference of the opening 81A. Further, the annular rib 156 is positioned outward of the contact parts 151B in a radial direction of the disc part 151A. As shown in FIGS. 10 and 13, the annular rib 156 can be made to contact and separate from the surface 151D of the disc part 151A through deflection (or deformation) of the end wall 154. As shown in FIG. 10, when the annular rib 156 contacts the surface 151D of the disc part 151A through deflection of the end wall 154, the annular rib 156 blocks the space between the end wall 154 and columnar portion 151, thereby closing the liquid channel. At this time, the end wall 154 is in the closed state. On the other hand, when deflection of the end wall 154 is relaxed, separating the annular rib 156 from the surface 151D of the disc part 151A, the space between the end wall 154 and columnar portion 151 is open, thereby opening the liquid channel. At this time, the end wall 154 is in its open state. In this way, the end wall 154 can open and close the liquid channel.

Note that the annular rib 156 need not be formed on the second surface 159. In this case, the second surface 159 may contact and separate from the surface 151D of the disc part 151A through deflection of the end wall 154.

The end wall 154 can be switched between its closed state shown in FIG. 10 and its open state shown in FIG. 13 by applying pressures to the first surface 158 and second surface 159, respectively. The pressure applied to the first surface 158 is pressure applied in the mounting direction 51 from the space constituting the through-hole 81 toward the first surface 158. The pressure applied to the second surface 159 is pressure applied in the removing direction 52 from the space between the end wall 154 and columnar portion 151 toward the second surface 159.

In order for the end wall 154 to deflect into the closed state shown in FIG. 10 so that the annular rib 156 contacts the surface 151D of the disc part 151A, a difference found by subtracting a value of the pressure applied to the second surface 159 from a value of the pressure applied to the first surface 158 must be equal to or larger than a threshold value, as will be described below. In order for the end wall 154 to return to the open state shown in FIG. 13 so that the annular rib 156 separates from the surface 151D of the disc part 151A, the difference found by subtracting the value of the pressure applied to the second surface 159 from the value of the pressure applied to the first surface 158 must be smaller than the threshold value.

The threshold value is determined based on a thickness of the end wall 154, surface areas of the first surface 158 and second surface 159, and properties and the like of the material forming the end wall 154. In the first embodiment, the threshold value is set larger than a difference found by subtracting a value of the pressure applied to the second surface 159 when the purging mechanism 120 draws ink from the nozzles 29 of the recording head 21 from a value of the pressure applied to the first surface 158 when the ink cartridge 30 is mounted in the cartridge-receiving section 110 and the air channel is open.

Here, the pressure applied to the first surface 158 when the air channel is in its open state is the pressure applied toward the first surface 158 in the mounting direction 51, and has a magnitude equivalent to normal atmospheric pressure. The pressure applied to the second surface 159 is pressure applied in the removing direction 52 toward the second surface 159 when the revolving rollers of the pump 124 are driven while the ink cartridge 30 is mounted in the cartridge-receiving section 110 and the cap 121 covers the nozzles 29. For example, if atmospheric pressure is X kilopascals (kPa) and the pressure applied to the second surface 159 during a purging operation is (X-Y) kPa, the threshold value is set to a value greater than Y kPa. For example, if atmospheric pressure is 100 kPa and the pressure applied to the second surface 159 during a purging operation is (100–2) kPa, i.e., 98 kPa, the threshold value is set to a value greater than 2 kPa, such as 10 kPa.

[Coil Spring 86]

As shown in FIGS. 9 and 10, the coil spring 86 (an example of a biasing member) is disposed between the surface 142A of the second inner wall 142 (see FIG. 5B) and the valve 77. Specifically, the coil spring 86 has one end that contacts the surface 142A, and another end that contacts the anchoring parts 153 of the retaining part 79 constituting the valve 77. The coil spring 86 urges the valve 77 in the mounting direction 51, thereby maintaining the valve 77 in its first state in the valve chamber 47 (see FIG. 10) for contacting the sealing member 70. Note that a plate spring or other urging member may be used in place of the coil spring 86.

<Operations for Mounting the Ink Cartridge 30 in the Cartridge-Receiving Section 110>

Next, the movement of the valve 77 during a process of mounting the ink cartridge 30 in the cartridge-receiving section 110 will be described with reference to FIGS. 10 through 13.

Prior to the ink cartridge 30 being mounted in the cartridge-receiving section 110, the valve 77 is in the first state shown in FIG. 10. In the first state, the valve 77 is made to contact the sealing member 70 by the urging force of the coil spring 86. More specifically, when the valve 77 is in the first state, the protruding part 151C of the retaining part 79 has advanced into the through-hole 71 formed in the sealing member 70 and forms a liquid-tight seal with the inner circumferential surface 70A of the sealing member 70, thereby closing the through-hole 71. Thus, the liquid channel is sealed off from the outside of the ink cartridge 30 at the through-hole 71.

At this time, the sealing part 84 is positioned between the openings 61 and 64 and is in close contact with the inner circumferential surface of the cylindrical wall 46. Accordingly, the sealing part 84 interrupts the communication of air between the openings 61 and 64, thereby interrupting the communication of air between the first air channel 60 and second air channel 63. Consequently, the ink chamber 36 is not in communication with the atmosphere. Note that the sealing part 84 may be arranged to partially overlap the openings 61 and 64, provided that communication of air is interrupted between the first and second air channels 60 and 63.

At the same time, the sealing part 85 is positioned downstream of the opening 61 in the mounting direction 51 and is in close contact with the inner circumferential surface of the cylindrical wall 46, thereby interrupting the communication of air and ink between the first air channel 60 and through-hole 71. Note that the sealing part 85 may also partially overlap the opening 61, provided that communication of air and ink is interrupted between the first air channel 60 and through-hole 71.

At the same time, the sealing part 87 is positioned downstream of the opening 64 in the removing direction 52 and contacts and forms a liquid-tight seal with the inner circumferential surface of the cylindrical wall 46, thereby interrupting the communication of air and ink between the second air channel 63 and second valve chamber 47B. Note that the sealing part 87 may also partially overlap the opening 64, provided that communication of air and ink is interrupted between the second air channel 63 and second valve chamber 47B.

When the valve 77 is in the first state, as described above, the ink chamber 36 is not in communication with the atmosphere. Therefore, the internal pressure of the ink chamber 36 is not necessarily at atmospheric pressure. In the first embodiment, when the valve 77 is in the first state, the internal pressure of the ink chamber 36 is higher than atmospheric pressure. Specifically, the internal pressure of the ink chamber 36 is greater than atmospheric pressure by at least the threshold value described above.

Since the internal pressure of the ink chamber 36 is greater than atmospheric pressure by at least the threshold value, the value obtained by subtracting the value of the pressure applied to the second surface 159 of the end wall 154 constituting the elastic member 82 from the value of the pressure applied to the first surface 158 of the end wall 154 is equal to or greater than the threshold value. Accordingly, the end wall 154 is in its closed state, i.e., is deflected such that the annular rib 156 contacts the surface 151D of the disc part 151A to close the liquid channel. Thus, the liquid channel is sealed off from the outside of the ink cartridge 30 at a position between the end wall 154 and columnar portion 151 in addition to the position of the through-hole 71 (due to contact between the protruding part 151C and the inner circumferential surface 70A constituting the through-hole 71).

FIG. 11 shows the internal state of the valve chamber 47 as the ink cartridge 30 is being mounted in the cartridge-receiving section 110 (when the ink needle 102 has been partially inserted into the through-hole 71 of the sealing member 70). As the ink cartridge 30 is being mounted in the cartridge-receiving section 110, the valve 77 is in an intermediate state at which the valve 77 has moved in the removing direction 52 from the first state against the urging force of the coil spring 86 due to pressure from the ink needle 102 inserted into the valve chamber 47 through the through-holes 76 and 71.

When the valve 77 is in this intermediate state, a portion of the protruding part 151C remains inserted in the through-hole 71 of the sealing member 70. That is, the protruding part 151C still forms a liquid-tight seal with the inner circumferential surface 70A of the sealing member 70. Accordingly, the protruding part 151C interrupts communication between the first valve chamber 47A and the through-holes 104 formed in the downstream end of the ink needle 102 in the removing direction 52. Thus, the liquid channel remains sealed off from the outside of the ink cartridge 30 at the through-hole 71.

In this state, the sealing part 84 is positioned between an edge of the opening 64 positioned downstream in the mounting direction 51 and another edge of the opening 64 positioned downstream in the removing direction 52. Accordingly, air can flow between the openings 61 and 64, and thus the first air channel 60 is in communication with the second air channel 63. Consequently, the ink chamber 36 is in communication with the atmosphere through the first air channel 60, the space between the sealing parts 84 and 85 (the first valve chamber 47A), and the second air channel 63. Thus, the air channel is open.

The sealing part 85 contacts the inner circumferential surface of the cylindrical wall 46 at a position downstream of the opening 61 in the mounting direction 51. Accordingly, the sealing part 85 interrupts communication of air and ink between the first and second air channels 60 and 63 and the through-hole 71.

The sealing part 87 contacts and forms a liquid-tight seal with the inner circumferential surface of the cylindrical wall 46 at a position downstream of the opening 64 in the removing direction 52. Accordingly, the sealing part 87 interrupts the communication of air and ink between the second air channel 63 and second valve chamber 47B.

When the valve 77 is in the intermediate state described above, the ink chamber 36 is in communication with the atmosphere. Accordingly, the internal pressure of the ink chamber 36 becomes atmospheric pressure after the valve 77 has been in the intermediate state for a prescribed time.

However, in the first embodiment it is assumed that the valve 77 moves from the first state to a second state described later after quickly passing through the intermediate state. Therefore, the valve 77 moves in the removing direction 52 from the intermediate state before the prescribed time elapses after arriving at the intermediate state. Accordingly, the internal pressure in the ink chamber 36 remains higher than atmospheric pressure while the valve 77 is in the intermediate state, just as when the valve 77 was in the first state. Accordingly, the end wall 154 is maintained in its closed state when the valve 77 is in the intermediate state. Hence, the liquid channel is sealed off from the outside of the ink cartridge 30 at the position between the end wall 154 and columnar portion 151 in addition to the position of the through-hole 71.

Figure 12:
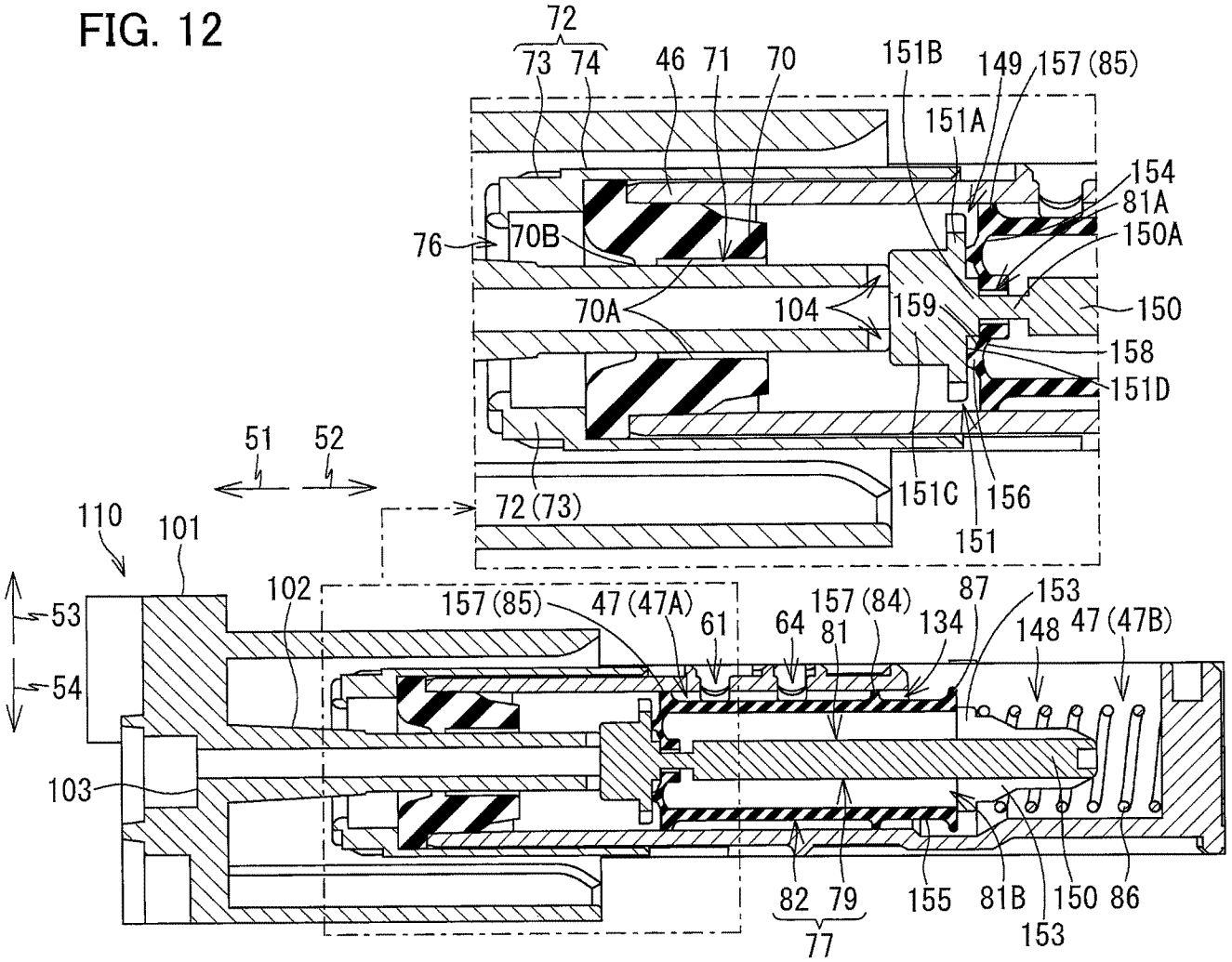
FIG. 12 is a cross-sectional view of the ink cartridge 30 according to the first embodiment taken along a plane corresponding to the plane B-B shown in FIG. 9A at a moment when the valve 77 has just arrived at its second state.

FIG. 12 shows the internal state of the valve chamber 47 at the instant the ink cartridge 30 becomes completely mounted in the cartridge-receiving section 110 (the state in which ink can flow out of the ink cartridge 30). When the ink cartridge 30 is completely mounted in the cartridge-receiving section 110, the valve 77 is in the second state in which the valve 77 has been moved in the removing direction 52 from the intermediate state against the urging force of the coil spring 86 due to the pressure applied by the ink needle 102 being further advanced into the valve chamber 47.

When the valve 77 is in the second state, the protruding part 151C has separated from the inner circumferential surface 70A defining the through-hole 71 in the sealing member 70. In other words, the retaining part 79 has been completely extracted from the through-hole 71 formed in the sealing member 70.

In this state, the ink needle 102 has been further inserted into the through-hole 71 of the sealing member 70 so that the communication holes 104 formed in the ink needle 102 have advanced past the through-hole 71 into the first valve chamber 47A. Consequently, the second space 149 of the first valve chamber 47A is in communication with the outside of the ink cartridge 30 through the communication holes 104 and the liquid channel formed inside the ink needle 102. However, since the end wall 154 is maintained in the closed state at the moment shown in FIG. 12, as will be described later, ink in the ink chamber 36 cannot flow outside the ink cartridge 30 through the communication holes 104 and the liquid channel formed inside the ink needle 102.

At this time, the sealing part 84 is in contact with the inner circumferential surface of the cylindrical wall 46 at a position downstream of the opening 64 in the removing direction 52. Accordingly, the sealing part 84 allows communication between the first and second air channels 60 and 63, as when the valve 77 is in the intermediate state, and thus the air channel is open.

At the same time, the sealing part 85 contacts the inner circumferential surface of the cylindrical wall 46 at a position downstream of the opening 61 in the mounting direction 51. Accordingly, the sealing part 85 interrupts communication of air and ink between the first and second air channels 60 and 63 and the through-hole 71.

In addition, the sealing part 87 has advanced through the first valve chamber 47A into the second valve chamber 47B. In other words, the sealing part 87 is positioned downstream of the cylindrical wall 46 in the removing direction 52 and, hence, is separated from the cylindrical wall 46. At this time, the sealing part 87 is at the same position in the mounting and removing directions 51 and 52 as the recessed parts 67 and 68 (see FIG. 5), and is therefore separated from the first inner wall 141 and fifth inner wall 145. Further, the sealing part 87 is positioned lower than the fourth inner wall 144 and separated from the same. The sealing part 87 is also positioned leftward from the film 37 and is separated from the same. With this arrangement, the sealing part 87 is not in contact with any wall surface as the valve 77 moves from the intermediate state toward the second state. In other words, by disposing the sealing part 87 at the same position as the recessed parts 67 and 68 in the mounting and removing directions 51 and 52 while the valve 77 is moved in the removing direction 52 from the first state, the sealing part 87 is separated from the wall surfaces defining the valve chamber 47. Thus, the number of sealing parts contacting the wall surfaces defining the valve chamber 47 is reduced from three (the sealing parts 84, 85, and 87) to two (the sealing parts 84 and 85), thereby reducing frictional resistance generated between the valve 77 and the wall surfaces.

In the first embodiment described above, the valve 77 is assumed to move quickly from the first state to the second state via the intermediate state. Therefore, at the instant the valve 77 arrives in the second state (the state shown in FIG. 12), the internal pressure of the ink chamber 36 remains higher than atmospheric pressure, as when the valve 77 was in the first state and the intermediate state. Therefore, the end wall 154 remains in its closed state at the moment the valve 77 reaches the second state. Accordingly, while the liquid channel is open at the through-hole 71, the liquid channel is sealed off from the outside of the ink cartridge 30 at the position between the end wall 154 and columnar portion 151.

FIG. 13 shows the internal state of the valve chamber 47 once the prescribed time has elapsed after the ink cartridge 30 has been completely mounted in the cartridge-receiving section 110. That is, FIG. 13 shows the internal state of the valve chamber 47 after the prescribed time has elapsed since the valve 77 arrived in the second state. Once the prescribed time has elapsed, the internal pressure of the ink chamber 36 has reached atmospheric pressure. Thus, the difference between the internal pressure of the ink chamber 36 and atmospheric pressure is less than the threshold value. In other words, the value obtained by subtracting the value of the pressure applied to the second surface 159 of the end wall 154 from the value of the pressure applied to the first surface 158 of the end wall 154 is less than the threshold value. Accordingly, the end wall 154, which was deflected due to the internal pressure of the ink chamber 36 being applied to the first surface 158, is now relaxed. Accordingly, the end wall 154 has moved to its open state, separating the annular rib 156 from the surface 151D of the disc part 151A. Thus, the liquid channel is open at the position between the end wall 154 and columnar portion 151.

Consequently, ink in the ink chamber 36 can flow out of the ink cartridge 30 through the communication path 130, second valve chamber 47B, first space 148, gaps between the neighboring two anchoring parts 153 juxtaposed in the circumferential direction of the body portion 150, the opening 81B formed in the cylindrical wall 155, the space formed in the through-hole 81 between the outer circumferential surface of the body portion 150 and the inner circumferential surface of the cylindrical wall 155, the opening 81A formed in the cylindrical wall 155, gaps between the neighboring two contact parts 151B juxtaposed in the circumferential direction of the body portion 150, the space between the end wall 154 and columnar portion 151, the second space 149, the communication holes 104, and the liquid channel formed inside the ink needle 102.

<Method of Manufacturing the Ink Cartridge 30>

Figure 14:
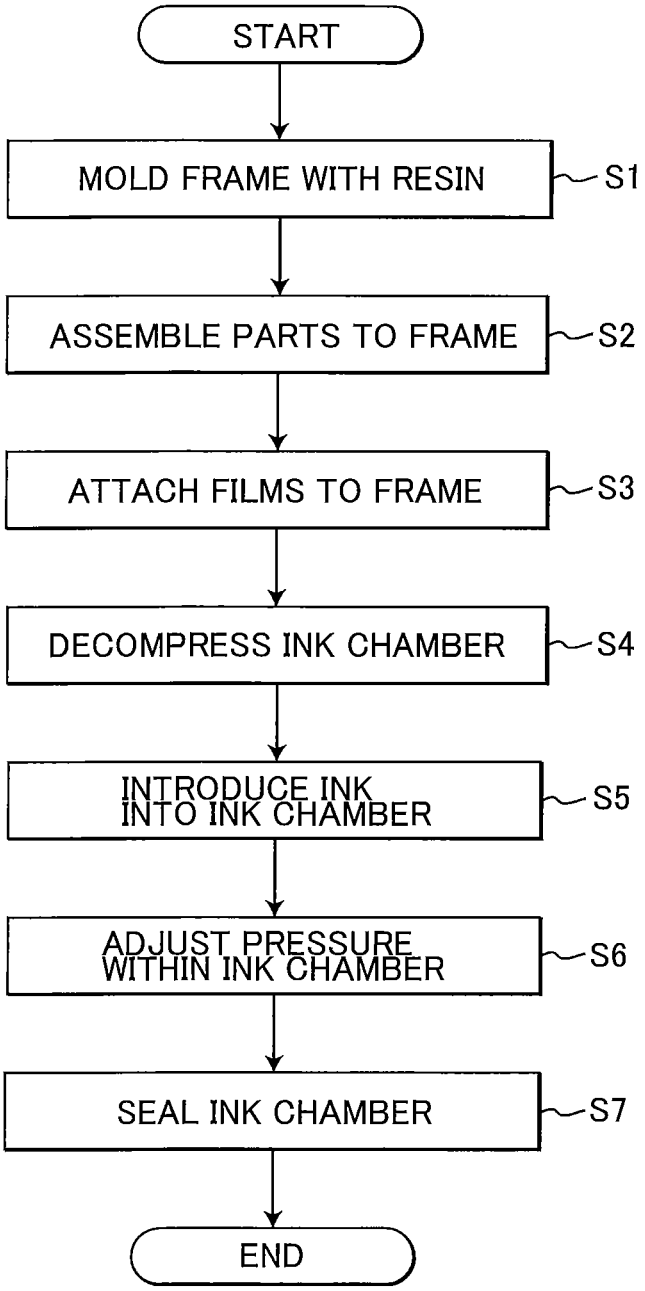
FIG. 14 is a flow chart illustrating a process for manufacturing the ink cartridge 30 according to the first embodiment.

Next, the method (process) of manufacturing the ink cartridge 30 according to the first embodiment will be described with reference to FIG. 14.

In order to manufacture the ink cartridge 30, first in S1, a molding step is performed to mold the frame 31. The frame 31 is typically formed through injection molding in which resin is poured into a die. Here, a retractable pin is arranged in the die in a region that will become the hollow space in the cylindrical wall 46 so that resin does not flow into the hollow space. When the frame 31 is molded in this way, the first valve chamber 47A is formed in the location of the pin.

Next, an assembling step is performed in S2. In this assembling step, the valve 77 and other components are arranged inside the frame 31 or attached to the frame 31.

Specifically, in the assembling step, the coil spring 86 is first inserted into the second valve chamber 47B through the aperture 66 (see FIG. 5). Next, the valve 77 is inserted into the first valve chamber 47A through the opening formed in the downstream end of the cylindrical wall 46 in the mounting direction 51 and is arranged in the first valve chamber 47A. At this time, one end of the coil spring 86 is in contact with the second inner wall 142, while the other end is in contact with the anchoring parts 153 of the valve 77.

Next in the assembling step, the sealing member 70 is fitted into the cap 72. Once the sealing member 70 has been fitted into the cap 72, the downstream end of the cylindrical wall 46 in the mounting direction 51 is fitted into the cap 72. In this state, the sealing member 70 is interposed between the cap 72 and cylindrical wall 46. Alternatively, the sealing member 70 may be fitted into the downstream end of the cylindrical wall 46 in the mounting direction 51, and subsequently the downstream end of the cylindrical wall 46 in the mounting direction 51 may be fitted into the cap 72 so that the cap 72 covers the sealing member 70.

Next, in S3, an attaching step is performed to attach the films 37 and 38. The films 37 and 38 are attached to the corresponding sides of the frame 31 through heat-sealing or high-frequency welding. Attaching the film 37 closes the right edges of the ink chamber 36, second valve chamber 47B, and communication path 130. The film 37 also closes the right edges of the first air channel 60 excluding the groove 60D, and the second air channel 63. Attaching the film 38 closes the left edges of the ink chamber 36 and communication path 130, as well as the left edge of the groove 60D constituting the first air channel 60.

Next, a decompressing step is performed in S4 to reduce pressure in the ink chamber 36 through the air channel. Decompression is performed by connecting a pressure reducing valve to the opening 62 in order to lower the pressure in the ink chamber 36 below atmospheric pressure. After the ink chamber 36 has been decompressed, the pressure reducing valve is closed to seal the opening 62. Note that the valve 77 is positioned in the first state due to the urging force of the coil spring 86 during the decompressing step.

Next, after the internal pressure in the ink chamber 36 has been reduced below atmospheric pressure in the decompressing step of S4, an ink filling step is performed in S5. In the ink filling step, the ink chamber 36 is filled with ink through the liquid channel. Ink is introduced into the ink chamber 36 by connecting an ink tank (not shown) containing ink to the cylindrical wall 46 through a tube (not shown), for example.

Specifically, one end of the tube is connected to the ink tank. The other end of the tube has a similar configuration to the ink needle 102 of the cartridge-receiving section 110. Thus, when the other end of the tube is connected to the cylindrical wall 46, this end pushes the valve 77 in the removing direction 52, thereby moving the valve 77 from the first state to the second state. When the valve 77 moves to the second state, the interior of the ink chamber 36 is in communication with the tube and the ink chamber 36 can be filled with ink introduced from the ink tank. Note that the air channel does not open when the valve 77 moves from the first state to the second state since the opening 62 was sealed in the decompressing step.

Since the pressure within the ink chamber 36 was reduced below atmospheric pressure in the decompressing step, the ink contained in the ink tank can flow into the ink chamber 36 through the tube, valve chamber 47, and communication path 130. Since the pressure in the ink chamber 36 is lower than atmospheric pressure, the value obtained by subtracting the value of the pressure applied to the second surface 159 of the end wall 154 from the value of the pressure applied to the first surface 158 of the end wall 154 is less than the threshold value, and hence the end wall 154 is in its open state. Accordingly, the end wall 154 does not interrupt the flow of ink from the ink tank to the ink chamber 36.

Once the ink filling step is completed, a pressure adjusting step is performed in S6 to adjust the pressure within the ink chamber 36 from its reduced pressure during the filling step. As described above, the pressure within the ink chamber 36 (internal pressure of the ink chamber 36) needs to be higher than atmospheric pressure in the first embodiment. Hence, in the pressure adjusting step of S6, the pressure in the ink chamber 36 is adjusted to become higher than atmospheric pressure. For example, the pressure within the ink chamber 36 is adjusted to be greater than atmospheric pressure by removing the pressure reducing valve from the opening 62, or by connecting a pressure increasing valve to the opening 62.

Alternatively, the pressure in the ink chamber 36 may be adjusted to be equivalent to atmospheric pressure in the pressure adjusting step of S6. If this is the case, by relocating the ink cartridge 30 to a higher altitude after the ink cartridge 30 has been manufactured so that the atmospheric pressure outside the ink cartridge 30 is lower, the pressure within the ink chamber 36 can be higher than atmospheric pressure. Note that, if the ink chamber 36 is filled with ink until the internal pressure of the ink chamber 36 reaches the atmospheric pressure in the ink filling step, the pressure adjusting step can be automatically performed during the ink filling step.

Finally, a sealing step is performed in S7 to seal the ink chamber 36 from the outside of the ink cartridge 30. Specifically, the end of the tube inserted into the cylindrical wall 46 is extracted therefrom, allowing the valve 77 to move from the second state back to the first state due to the urging force of the coil spring 86. When in the first state, the valve 77 (and specifically the protruding part 151C of the valve 77) closes the through-hole 71, while the air channel is closed by the sealing part 84 positioned between the openings 61 and 64. In this way, the ink chamber 36 is sealed off from the outside of the ink cartridge 30. Manufacturing of the ink cartridge 30 is thus completed.

<Operations and Technical Advantages of the First Embodiment>

When molding the frame 31 according to the first embodiment described above, the pin is disposed in the region of the valve chamber 47 corresponding to the first valve chamber 47A, but not in a region corresponding to the second valve chamber 47B, since the area of the valve chamber 47 corresponding to the second valve chamber 47B is open on the side facing in the rightward direction 55. Hence, this configuration reduces the required length of the pin disposed in the region corresponding to the valve chamber 47 as a whole when molding the frame 31. This can reduce a probability that the pin will tilt during the molding step due to pressure applied by resin when the resin is poured into the die. Therefore, the cylindrical wall 46 and the first through fifth inner walls 141-145 defining the valve chamber 47 of the ink cartridge 30 can be precisely molded.

Further, the valve chamber 47 is made longer in the mounting direction 51 than otherwise, since the coil spring 86 is disposed in the valve chamber 47 in the first embodiment. However, the structure of the first embodiment enables the cylindrical wall 46 and the first through fifth inner walls 141-145 defining the valve chamber 47 to be molded precisely.

In the first embodiment, the coil spring 86 can be inserted into the second valve chamber 47B through the aperture 66, and the aperture 66 can subsequently be closed with the film 37.

In the first embodiment described above, the valve 77 is configured to move so as to allow or interrupt communication between the first air channel 60 and second air channel 63. Hence, the valve 77 moves over a considerably long range in the mounting and removing directions 51 and 52, necessitating an increase in the length of the valve chamber 47 in the mounting direction 51. However, by configuring the second valve chamber 47B to be open on the side facing in the rightward direction 55, the cylindrical wall 46 and the first through fifth inner walls 141-145 defining the valve chamber 47 can be precisely molded.

Further, in the depicted embodiment, the valve 77 passes through the intermediate state while moving from the first state to the second state. Hence, the valve 77 travels a greater distance in the mounting and removing directions 51 and 52, necessitating an increase in the length of the valve chamber 47 in the mounting direction 51. However, by configuring the second valve chamber 47B to be open on the side facing in the rightward direction 55, the cylindrical wall 46 and the first through fifth inner walls 141-145 defining the valve chamber 47 can be precisely molded.

Further, since the valve 77 can move between the first state and second state, the structure for opening the through-hole 71 and the air channel can be achieved with the single valve 77.

Further, when the valve 77 is in the first state, ink does not flow out of the ink cartridge 30 because the columnar portion 151 closes the through-hole 71. Further, the ink chamber 36 is in a closed state, since the sealing part 84 (air channel closing part 157) closes the communication between the first air channel 60 and second air channel 63, thereby closing the air channel. When the valve 77 is in the intermediate state, the ink chamber 36 is made in communication with the atmosphere via the first air channel 60, the space between the sealing parts 84 and 85, and the second air channel 63. On the other hand, ink does not flow out of the ink cartridge 30 because the columnar portion 151 closes the through-hole 71. When the valve 77 is in the second state, since the columnar portion 151 opens the through-hole 71, the ink chamber 36 can communicate with the outside of the ink cartridge 30, enabling ink to flow out of the ink cartridge 30. Thus, the structure of the first embodiment described above enables the ink chamber 36 to communicate with the atmosphere before ink is able to flow out of the ink cartridge 30. That is, this arrangement can prevent ink in the ink chamber 36 from flowing out of the ink cartridge 30 due to the internal pressure of the ink chamber 36 when the columnar portion 151 opens the through-hole 71.

If the ink chamber 36 communicates with the outside of the ink cartridge 30 when the pressure in the ink chamber 36 is greater than atmospheric pressure, ink in the ink chamber 36 will flow out of the ink cartridge 30. However, since the end wall 154 closes the liquid channel even in such cases, the structure of the depict embodiment can prevent ink in the ink chamber 36 from flowing out of the ink cartridge 30.

In the first embodiment described above, the valve 77 can move from the first state to the second state via the intermediate state. The internal pressure of the ink chamber 36 remains higher than atmospheric pressure when the valve 77 is in the intermediate state while moving quickly from the first state to the second state via the intermediate state, just as when the valve 77 is in the first state. However, the pressure in the ink chamber 36 could equalize to atmospheric pressure while the valve 77 is in the intermediate state if the movement of the valve 77 is slow.

If the valve 77 is rapidly moved from the first state to the second state via the intermediate state, there is concern that the columnar portion 151 could open the through-hole 71 when the valve 77 arrives in the second state before the internal pressure of the ink chamber 36 can equalize to atmospheric pressure after air is allowed to communicate between the openings 61 and 64 in the intermediate state. In such a case, ink could flow out of the ink cartridge 30 due to the internal pressure of the ink chamber 36. However, according to the structure of the first embodiment, since the end wall 154 keeps the liquid channel closed even in this case, ink in the ink chamber 36 can be prevented from flowing out of the ink cartridge 30. Naturally, the pressure in the ink chamber 36 could equalize to atmospheric pressure when the valve 77 is in the intermediate state if the movement of the valve 77 is slow. In this case, the end wall 154 opens the liquid channel while the valve 77 is still in the intermediate state.

The end wall 154 can close the liquid channel as long as the value obtained by subtracting the value of the pressure applied to the second surface 159 from the value of the pressure applied to the first surface 158 is equal to or greater than the threshold value, even if the columnar portion 151 has opened the through-hole 71 while the air channel is closed by the air channel closing part 157 (sealing parts 84 and 85). This arrangement can prevent ink in the ink chamber 36 from flowing out of the ink cartridge 30 via the liquid channel and the through-hole 71.

When the air channel closing part 157 subsequently opens the air channel (the space between the sealing parts 84 and 85 is in communication with the openings 61 and 64), the internal pressure of the ink chamber 36 becomes equal to atmospheric pressure. As a result, the value obtained by subtracting the pressure applied to the second surface 159 of the end wall 154 from the pressure applied to the first surface 158 becomes less than the threshold value, causing the end wall 154 to open the liquid channel. Thus, ink in the ink chamber 36 can now flow out of the ink cartridge 30 through the through-hole 71.

The threshold value is set larger than a value obtained by subtracting the value of the pressure applied to the second surface 159 of the end wall 154 when the purging mechanism 120 draws ink from the nozzles 29 of the recording head 21 from the value of the pressure applied to the first surface 158 while the air channel is in an open state. Accordingly, the end wall 154 does not close the liquid channel even when the purging mechanism 120 is drawing ink. In other words, the end wall 154 does not prevent the purging mechanism 120 from conducting its suction operation.

Note that the pressure applied to the second surface 159 while the recording head 21 ejects ink is greater than the pressure applied to the second surface 159 when the purging mechanism 120 draws ink from the nozzles 29 of the recording head 21. Hence, the end wall 154 does not prevent the recording head 21 from performing ink ejection operations.

Further, if the ink cartridge 30 were not provided with the sealing part 87, the ink chamber 36 would be in communication with the valve chamber 47 via the opening 64 when the valve 77 was in the first state. As a consequence, air in the ink chamber 36 could enter the valve chamber 47 via the second air channel 63, depending on the orientation of the ink cartridge 30. When the valve 77 was then moved into the second state in order to supply ink outside the ink cartridge 30, the air that entered the valve chamber 47 could exit the ink cartridge 30 through the through-hole 71, instead of the ink. However, in the first embodiment, the sealing part 87 interrupts the flow of ink between the opening 64 and valve chamber 47 when the valve 77 is in the first state. Accordingly, air is suppressed from exiting the ink cartridge 30 through the through-hole 71 when the valve 77 is in the second state.

Further, when the valve 77 is moved in the removing direction 52 from the first state toward the second state, the sealing part 87 is moved to the same position as the recessed parts 67 and 68 in the mounting and removing directions 51 and 52 and is separated from the wall surfaces configuring the valve chamber 47. In this way, frictional resistance generated between the valve 77 and the wall surfaces can be reduced when the valve 77 moves in the removing direction 52, thereby enabling the valve 77 to move smoothly in the removing direction 52.

Since the air channel closing part 157 (the sealing parts 84 and 85) and end wall 154 are integrally configured, the number of parts required in the ink cartridge 30 can be reduced Further, by providing the valve 77 with the columnar portion 151 and air channel closing part 157 (sealing parts 84 and 85), the single valve 77 can open the through-hole 71 and the air channel. Accordingly, this configuration can further reduce the number of required parts in the ink cartridge 30.

The sealing part 87 has an annular shape in the first embodiment when viewed in the mounting direction 51. The sealing part 87 with such a simple structure can interrupt the flow of ink between the opening 64 and valve chamber 47.

Further, since the sealing parts 84, 85, and 87 and the inner circumferential surface of the cylindrical wall 46 are annular shaped with a circular cross section, the sealing parts 84, 85, and 87 can uniformly contact the inner circumferential surface of the cylindrical wall 46.

Still further, the coil spring 86 is provided for urging the valve 77 in the mounting direction 51 toward the first state. Therefore, the valve 77 can close the through-hole 71 when no force other than the coil spring 86 is applied to the valve 77. This arrangement reduces the probability that ink in the ink chamber 36 will flow out of the ink cartridge 30.

When the ink cartridge 30 is in its operational state, ink stored in the ink chamber 36 flows out of the ink cartridge 30 through the valve chamber 47 provided in the bottom of the ink chamber 36. Accordingly, the ink cartridge 30 can be used until the ink stored in the ink chamber 36 has run out.

Further, in the process of manufacturing the ink cartridge 30 according to the first embodiment, the internal pressure of the ink chamber 36 is reduced during the decompressing step, facilitating the operation to fill the ink chamber 36 with ink in the ink filling step. Further, the pressure in the ink chamber 36 is set greater than atmospheric pressure in the pressure adjusting step to allow the end wall 154 to deflect into the closed state to close the liquid channel. Hence, this process can reduce the potential for ink flowing out of the ink cartridge 30 attributed to the internal pressure of the ink chamber 36.

2. Second Embodiment

Figure 15:
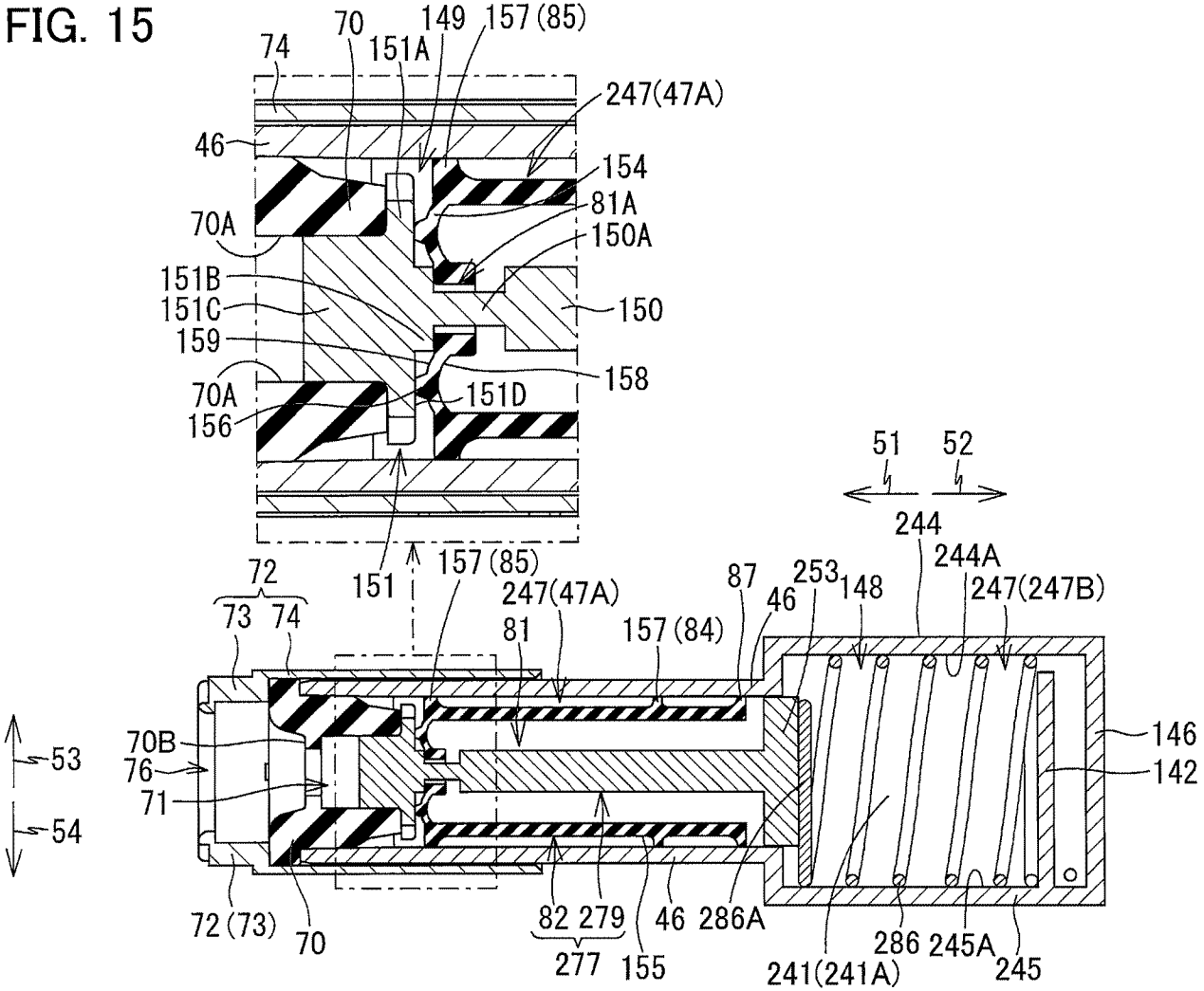
FIG. 15 is a vertical cross-sectional view showing structures of a valve 277 and in the vicinity thereof in a configuration according to a second embodiment of the present disclosure.

Next, a structure according to a second embodiment will be described with reference to FIG. 15.

In the second embodiment, structures corresponding to the second valve chamber 47B and in the vicinity thereof differ from those in the first embodiment. The remaining structure of the ink cartridge of the second embodiment is generally the same as that in the first embodiment. Hence, the following description focuses on structural parts that differ from the first embodiment, while like parts and components are designated by the same reference numerals as those of the first embodiment to avoid duplicating description. It should be also noted that in FIG. 15, the first opening 61 and the second opening 64 are omitted.

Specifically, a valve chamber 247 according to the second embodiment includes the first valve chamber 47A and a second valve chamber 247B.

A coil spring 286 is disposed in the second valve chamber 247B. The coil spring 286 has a dimension greater than the dimension of the first valve chamber 47A in a direction orthogonal to the mounting and removing directions 51 and 52 (i.e., in the downward and upward directions 53 and 54, as well as in the rightward and leftward directions 55 and 56 in the second embodiment, and hereinafter, simply referred to as "orthogonal direction"). That is, the coil spring 286 has an outer diameter larger than the inner diameter of the first valve chamber 47A. The second valve chamber 247B is configured large enough to allow insertion and deployment of the coil spring 286 therein. In other words, the second valve chamber 247B has a greater dimension than the coil spring 286 in the orthogonal direction.

In the first embodiment, as illustrated in FIG. 5A, the recessed part 68 is formed in the fifth inner wall 145 and the recessed part 67 is formed in the first inner wall 141. However, in the second embodiment, these recessed parts 67 and 68 are not formed. Instead, in the second embodiment, as shown in FIG. 15, a fifth inner wall 245 has a surface 245A facing the second valve chamber 247B that is positioned lower than the bottom edge of the inner circumferential surface of the cylindrical wall 46. Further, although not discernible in FIG. 15, a first inner wall 241 has a surface 241A facing the second valve chamber 247B that is positioned farther leftward than the left edge of the inner circumferential surface of the cylindrical wall 46. Further, a fourth inner wall 244 has a surface 244A facing the second valve chamber 247B that is positioned higher than the top edge of the inner circumferential surface of the cylindrical wall 46, and the film 37 (see FIG. 4) is positioned farther rightward than the right edge of the inner circumferential surface of the cylindrical wall 46.

With this construction, the surfaces extending in the mounting direction 51 that defining the second valve chamber 247B (i.e., the surfaces 241A, 244A, and 245A, and the surface of the film 37 facing the second valve chamber 247B) are positioned radially outward of the inner circumferential surface of the cylindrical wall. In this way, the coil spring 286 having a larger outer diameter than the inner diameter of the first valve chamber 47A is disposed in the second valve chamber 247B.

Note that a valve 277 (retaining part 279) of the second embodiment has a downstream end in the removing direction 52 (anchoring parts 253) that protrudes from the first valve chamber 47A into the second valve chamber 247B. Additionally, an end 286A of the coil spring 286 positioned downstream in the mounting direction 51 extends from a peripheral portion toward a center region of the coil spring 286 in a radial direction of the same. With this configuration, the end 286A of the coil spring 286 having a larger outer diameter than the inner diameter of the cylindrical wall 46 can be placed in contact with the anchoring parts 253 of the valve 277 having a smaller diameter than the inner diameter of the cylindrical wall 46.

This structure of the second embodiment can allow use of the coil spring 286 having a larger diameter than the coil spring 86 that can be disposed in the first valve chamber 47A. The coil spring 286 with a larger diameter can urge the valve 77 with greater force than the coil spring 86 does.

3. Third Embodiment

Next, a structure according to a third embodiment will be described with reference to FIGS. 16 and 17.

In the first embodiment described above, the end wall 154 is provided on the valve 77 as a member for opening and closing the liquid channel. However, the member for opening and closing the liquid channel may be provided on a member other than the valve 77.

In an ink cartridge 330 according to the third embodiment, the member for opening and closing the liquid channel is mounted on a frame, unlike in the ink cartridge 30 of the first embodiment. The remaining structure of the ink cartridge 330 according to the third embodiment is generally the same as that in the first embodiment. Accordingly, the following description focuses on structural parts that differ from the first embodiment, while like parts and components are designated with the same reference numerals as those of the first embodiment to avoid duplicating description.

Figure 16:
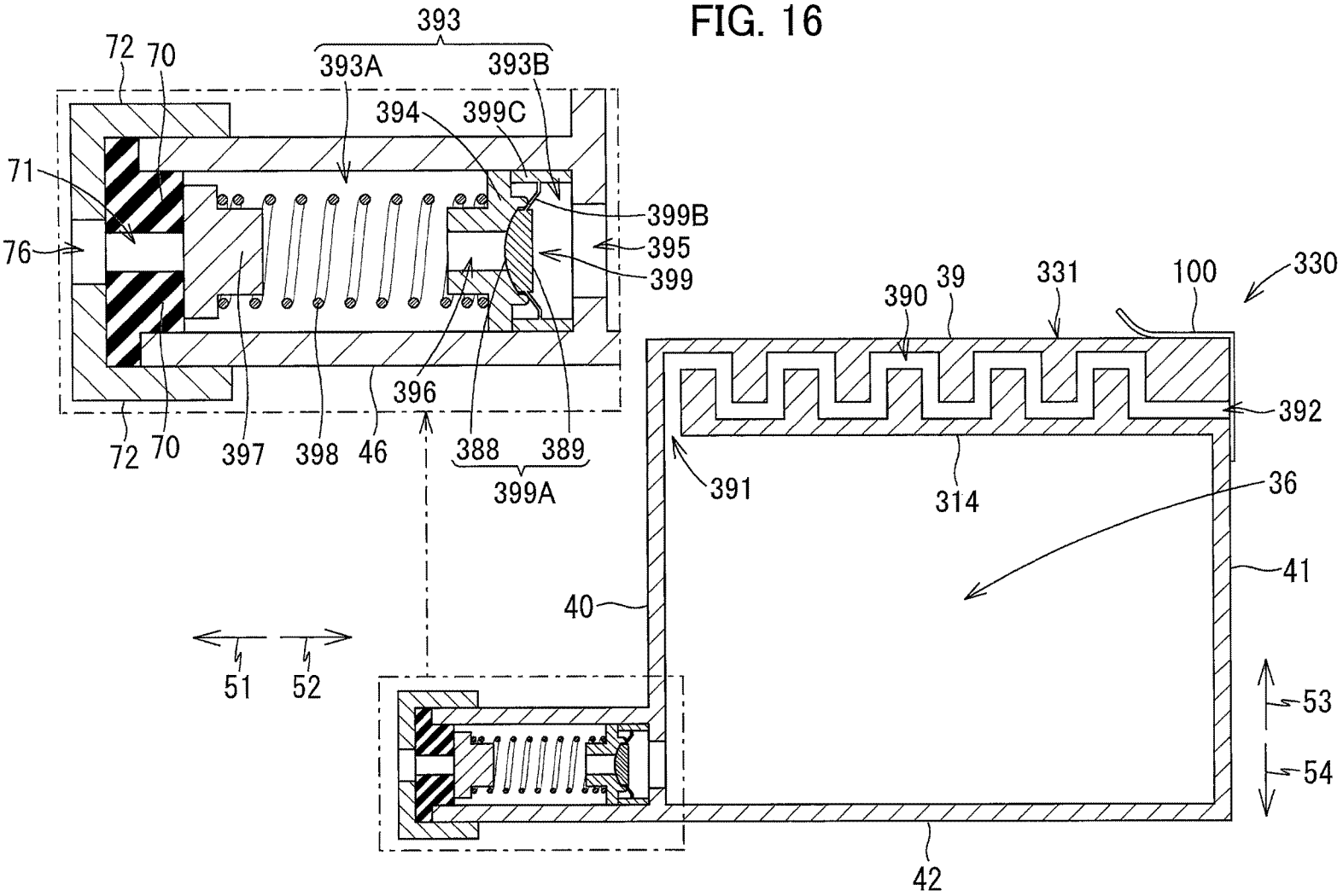
FIG. 16 is a vertical cross-sectional view of an ink cartridge 330 according to a third embodiment of the present disclosure as viewed from its right side, wherein a valve body 397 is in a first state.
Figure 17:
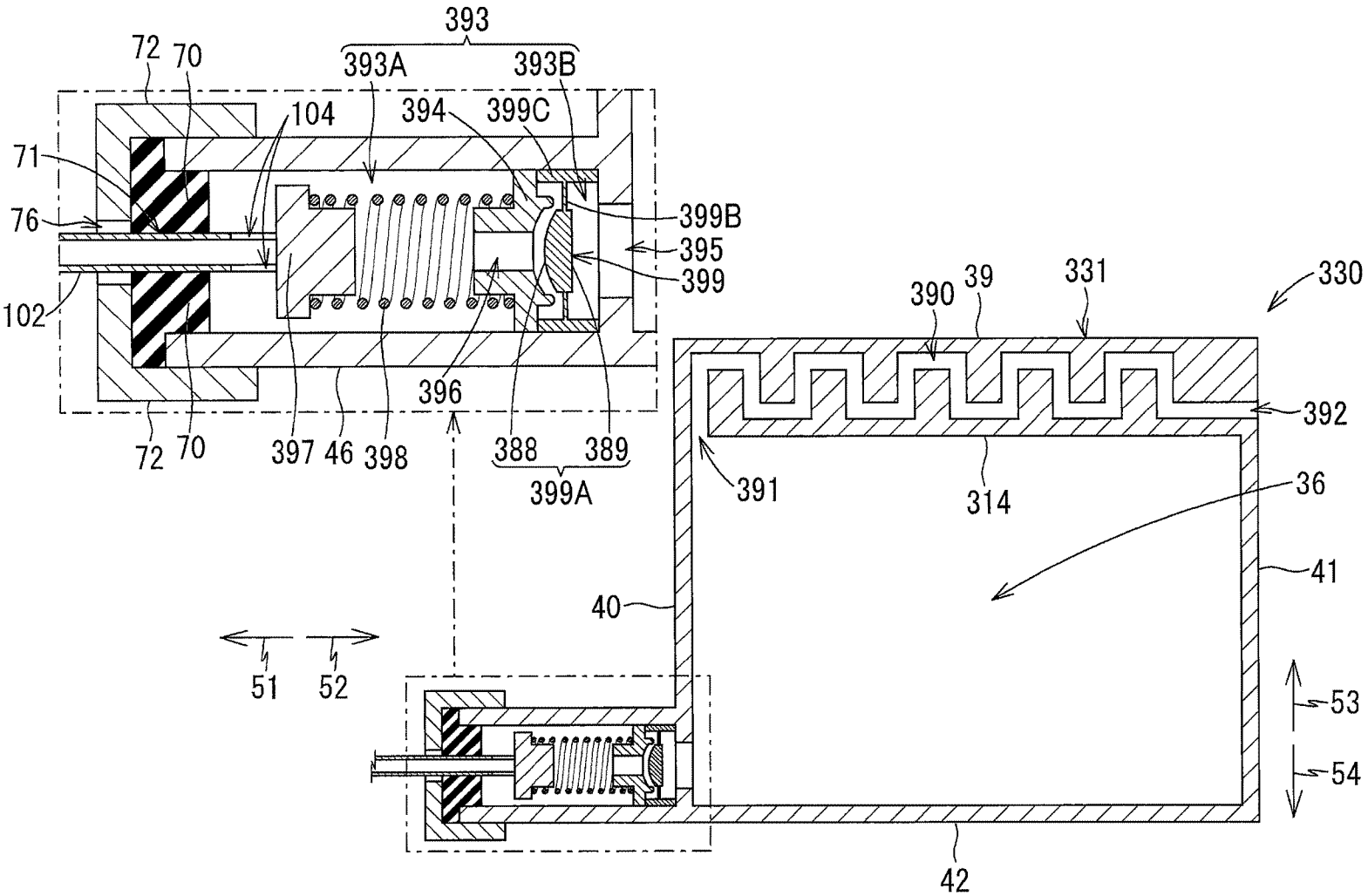
FIG. 17 is a vertical cross-sectional view of the ink cartridge 330 according to the third embodiment of the present disclosure as viewed from its right side, wherein the valve body 397 is in a second state.

Specifically, referring to FIGS. 16 and 17, the ink cartridge 330 of the third embodiment includes a frame 331 in which an air channel 390 is formed. The air channel 390 extends from the ink chamber 36 to the outside of the ink cartridge 330 and serves primarily to provide air flow. Specifically, the air channel 390 has one end in communication with the ink chamber 36 via an opening 391 formed in a top inner wall 314, while another end of the air channel 390 is in communication with the exterior of the ink cartridge 330 through an opening 392 formed in an upper portion of the rear wall 41. The air channel 390 meanders while extending from the opening 391 to the opening 392, forming a labyrinthine structure.

In other words, the air channel 390 of the third embodiment does not pass through a valve chamber 393 (described later) formed in the frame 331, unlike the air channel of the first embodiment.

As in the first embodiment, the sealing member 70 and cap 72 are mounted in the tip end of the cylindrical wall 46 (the downstream end of the cylindrical wall 46 in the mounting direction 51). The base end of the cylindrical wall 46 (the downstream end of the cylindrical wall 46 in the removing direction 52) communicates with the ink chamber 36 via a through-hole 395.

The valve chamber 393 is a space defined by the inner circumferential surface of the cylindrical wall 46. A partitioning wall 394 partitions the valve chamber 393 into a first valve chamber 393A and a second valve chamber 393B. The first valve chamber 393A is formed so as to be offset in the mounting direction 51 from the second valve chamber 393B.

A through-hole 396 is formed in the partitioning wall 394, penetrating the partitioning wall 394 in the mounting and removing directions 51 and 52. The first valve chamber 393A and second valve chamber 393B are in communication with each other through the through-hole 396.

A liquid channel extends from the ink chamber 36 to the outside of the ink cartridge 330 for primarily providing ink flow. In the third embodiment, the valve chamber 393 serves as the liquid channel. One end of the liquid channel is in communication with the ink chamber 36 via the through-hole 395, while the other end is in communication with the outside of the ink cartridge 330 via the through-holes 71 and 76.

Within the first valve chamber 393A, a valve member 397 and a coil spring 398 are disposed. The valve member 397 is positioned offset in the mounting direction 51 from the coil spring 398 (i.e., downstream of the coil spring 398 in the mounting direction 51). The valve member 397 is a general columnar-shaped member. One end of the coil spring 398 is in contact with the valve member 397, while the other end is in contact with the partitioning wall 394. With this structure, the coil spring 398 can urge the valve member 397 in the mounting direction 51, thereby maintaining the valve member 397 in a first state in the valve chamber 393, such that the valve member 397 contacts the sealing member 70. Note that a plate spring or other urging member may be used in place of the coil spring 398. The valve member 397 is an example of the first closing part.

Within the second valve chamber 393B, a closing member 399 is disposed as an example of the third closing part. The closing member 399 is configured of a plate-like cover part 399A, a flexible membrane part 399B, and a cylindrical part 399C. The membrane part 399B surrounds the cover part 399A and is integrally formed with the cover part 399A. The cylindrical part 399C is provided on and along an outer edge of the membrane part 399B.

The cover part 399A has a surface 388 that confronts the partitioning wall 394 in the mounting and removing directions 51 and 52, and a surface 389 on the opposite side from the surface 388. The surface 389 is an example of the first surface and surface 388 is an example of the second surface.

The closing member 399 is mounted within the cylindrical wall 46 by inserting the cylindrical part 399C therein. The cylindrical part 399C has an outer diameter corresponding to the inner diameter of the cylindrical wall 46. Therefore, the cylindrical part 399C can be inserted into the cylindrical wall 46 without play.

The surface 388 of the cover part 399A can contact and separate from the partitioning wall 394 through deflection of the membrane part 399B. When the surface 388 is in contact with the partitioning wall 394 as shown in FIG. 16, the cover part 399A blocks the through-hole 396, i.e., closes the liquid channel. However, when the surface 388 is separated from the partitioning wall 394 as shown in FIG. 17, the through-hole 396 is opened and, thus, the liquid channel is open. In this way, the closing member 399 can open and close the liquid channel.

According to the pressure applied by ink on the surfaces 388 and 389 of the cover part 399A, the closing member 399 can change between a closed state shown in FIG. 16 in which the surface 388 contacts the partitioning wall 394 and blocks the liquid channel, and an open state shown in FIG. 17 in which the surface 388 separates from the partitioning wall 394 and opens the liquid channel. Pressure applied to the surface 389 of the cover part 399A is ink pressure applied from the second valve chamber 393B in the mounting direction 51 toward the surface 389. Pressure applied to the surface 388 is pressure applied by ink in the removing direction 52 from the first valve chamber 93A toward the surface 388 via the through-hole 396.

The membrane part 399B deflects so that the closing member 399 shifts to the closed state shown in FIG. 16 when a value obtained by subtracting the pressure applied to the surface 388 from the pressure applied to the surface 389 is equal to or larger than a threshold value. On the other hand, deflection in the membrane part 399B is relaxed, allowing the closing member 399 to change to its open state shown in FIG. 17, when the value obtained by subtracting the pressure applied to the surface 388 from the pressure applied to the surface 389 is smaller than the threshold value.

The threshold value is set based on the thickness and properties of the material composing the membrane part 399B and cover part 399A, areas of the surfaces 388 and 389 of the cover part 399A, and the like. As in the first embodiment, the threshold value in the third embodiment is set larger than a value obtained by subtracting a value of the pressure applied to the surface 388 when the purging mechanism 120 draws ink from the nozzles 29 of the recording head 21 from a value of the pressure applied to the surface 389 when the air channel 390 is open.

Prior to the ink cartridge 330 being mounted in the cartridge-receiving section 110, the valve member 397 is in its first state shown in FIG. 16 in which the valve member 397 is made to contact the sealing member 70 by the urging force of the coil spring 398. Thus, in the first state, the valve member 397 seals the through-hole 71. Consequently, the liquid channel is sealed off from the exterior of the ink cartridge 330 at the position of the through-hole 71.

Further, a seal 100 (an example of a second closing part) is affixed to the rear wall 41 and top wall 39 of the frame 331. The seal 100 covers the opening 392, interrupting communication between the interior of the ink chamber 36 and the exterior of the ink cartridge 330. In other words, the seal 100 prevents the ink chamber 36 from communicating with the atmosphere. Hence, the internal pressure of the ink chamber 36 is not necessarily atmospheric pressure. As in the first embodiment, the internal pressure of the ink chamber 36 when the valve member 397 is in the first state is greater than atmospheric pressure by at least the threshold value in the third embodiment. Note that, in the third embodiment, the rear wall 41 and top wall 39 constitutes outermost walls of the ink cartridge 330. Accordingly, the user can peel the seal 100 off the rear wall 41 and top wall 39.

Since the internal pressure of the ink chamber 36 is greater than atmospheric pressure by at least the threshold value, the value obtained by subtracting the value of the pressure applied to surface 388 from the value of the pressure applied to the surface 389 of the cover part 399A is equal to or larger than the threshold value. Therefore, the closing member 399 is set in its closed state, blocking the liquid channel. In other words, the liquid channel is sealed off from the exterior of the ink cartridge 330 at the position of the through-hole 396 in addition to the position of the through-hole 71.

After the ink cartridge 330 is completely mounted in the cartridge-receiving section 110, the valve member 397 is in the second state shown in FIG. 17 having been moved in the removing direction 52 from the first state against the urging force of the coil spring 398 by being pushed by the ink needle 102 inserted into the first valve chamber 393A. At this time, the valve member 397 is separated from the sealing member 70, thereby opening the through-hole 71.

Normally, the seal 100 is peeled off the ink cartridge 330 prior to the ink cartridge 330 being mounted in the cartridge-receiving section 110. In this way, the ink chamber 36 is opened to the atmosphere, enabling the internal pressure of the ink chamber 36 to equalize to atmospheric pressure. As a result, the value obtained by subtracting the value of the pressure applied to the surface 388 from the value of the pressure applied to the surface 389 in the closing member 399 is less than the threshold value. Consequently, the closing member 399 changes to its open state, opening the through-hole 396.

Since the through-hole 71 and through-hole 396 are both open when the ink cartridge 330 has been completely mounted in the cartridge-receiving section 110 as described above, the ink stored in the ink chamber 36 can flow out of the ink cartridge 330 through the liquid channel.

If the seal 100 were not peeled off the ink cartridge 330 before the ink cartridge 330 was mounted in the cartridge-receiving section 110, the pressure in the ink chamber 36 would be maintained higher than atmospheric pressure by at least the threshold value. Accordingly, this pressure would attempt to force the ink stored in the ink chamber 36 out of the ink cartridge 330 through the liquid channel. However, since the internal pressure of the ink chamber 36 is greater than atmospheric pressure by at least the threshold value in this case, the closing member 399 is in its closed state and thus prevents the ink flow from the ink chamber 36 to the through-hole 396. Accordingly, ink cannot flow out of the ink cartridge 330.

4. Modifications and Variations

In the first embodiment, portions of the air channel and liquid channel pass through the valve chamber 47. In the third embodiment, the entire liquid channel passes through the valve chamber 393. However, the air channel and liquid channel of the present disclosure are not limited to the paths described in the first and third embodiments. For example, the entire air channel may also pass through the valve chamber.

In the first embodiment, the columnar portion 151 of the valve 77 is provided with the protruding part 151C. However, the ink needle 102 may be provided with the protruding part 151C instead. In this case, the protruding part 151C constitutes the protruding distal end of the ink needle 102 that protrudes farther in the removing direction 52 than a portion of the ink needle 102 in which the communication holes 104 are formed. Further, when the valve 77 is in the first state, the disc part 151A of the columnar portion 151 is pressed against the sealing member 70 by the urging force of the coil spring 86, blocking the through-hole 71. In other words, the disc part 151A serves as the first closing part in this case.

Alternatively, a member configured to slide while being in close contact with the inner circumferential surface 70A of the sealing member 70 as the valve 77 moves (the protruding part 151C in the first embodiment) may be provided on both of the valve 77 and the ink needle 102. In this case, total lengths in the mounting and removing directions 51 and 52 of the respective members provided on the valve 77 and ink needle 102 is set greater than the length in the mounting and removing directions 51 and 52 between the sealing part 84 and opening 64 when the valve 77 is in the first state and shorter than the length in the mounting and removing directions 51 and 52 between the sealing part 85 and opening 61 when the valve 77 is in the first state.

Further, the semipermeable membrane may be attached at any position along the path of the first air channel 60 and is not limited to the position of the annular rib 200 as in the first embodiment. In this case, preferably, the semipermeable member be disposed between the labyrinthine structure 69 and opening 62, in order to suppress deposits of ink on the semipermeable membrane from inhibiting the circulation of air.

In the first embodiment, the sealing part 87 has an annular shape when viewed in the mounting direction 51. However, the sealing part 87 need not be annular in shape, provided that the sealing part 87 can interrupt the flow of ink between the opening 64 and the liquid channel when the valve 77 is in the first state.

For example, the sealing part 87 may be a columnar-shaped protrusion that protrudes radially outward from the outer surface of the cylindrical wall 155. In this case, the columnar protrusion should have a protruding endface (circular when viewed in the radial direction) that is large enough to entirely cover the opening 64. With this structure, when the valve 77 is in the first state, this columnar protrusion serving as the sealing part 87 forms a liquid-tight and airtight seal with a portion of the inner circumferential surface of the cylindrical wall 46 that includes the opening 64. In this way, the columnar-shaped sealing part 87 covers the opening 64, thereby interrupting the ink flow between the opening 64 and valve chamber 47. When the valve 77 is moved in the removing direction 52 from the first state, the sealing part 87 moves to a position offset in the removing direction 52 from the opening 64, whereby ink can flow between the opening 64 and valve chamber 47.

Further, in the first embodiment, the inner circumferential surface of the cylindrical wall 46 and outer circumferential surface of the sealing parts 84, 85, and 87 are circular in shape in a cross section taken orthogonal to the mounting and removing directions 51 and 52. However, the cross-sectional shapes of these members are not limited to a circular shape and may be elliptical or rectangular, for example. Similarly, the cross-sectional shape of the outer circumferential surface of the cylindrical wall 46 and other components is not limited to be circular.

The sealing parts 84, 85, and 87 may be configured of O-rings or the like that fit into circumferential grooves formed in the elastic member 82, for example.

Further, the openings 61 and 64 are formed in the same position in the circumferential direction of the cylindrical wall 46 while being separated from each other in the mounting and removing directions 51 and 52 in the first embodiment, but the positional relationship of these openings 61 and 64 is not limited to the example of the first embodiment. For example, the openings 61 and 64 may be provided at the same position in the mounting and removing directions 51 and 52 while being separated in the circumferential direction of the cylindrical wall 46, or may be provided at positions separated in both the mounting and removing directions 51 and 52 and the circumferential direction of the cylindrical wall 46. In such cases, the sealing part 84 may be formed in any shape on the valve 77 as long as the sealing part 84 can interrupt communication between the openings 61 and 64 (i.e., provided that the sealing part 84 is annular and makes a loop around the entire circumference of the elastic member 82) when the valve 77 is in the first state.

For example, the sealing part 84 may circumscribe the outer circumferential surface of the elastic member 82 along a plane that intersects the mounting and removing directions 51 and 52 (an orthogonal plane in the first embodiment). The sealing part 84 also need not be provided within a single plane, but may curve or meander around the elastic member 82. In such a case, a portion of the sealing part 84 may extend in the mounting and removing directions 51 and 52. The same structural modifications may also be applied to the sealing parts 85 and 87. Further, one of the openings 61 and 64 may be formed in another wall defining the valve chamber 47, such as the second inner wall 142 or fourth inner wall 144, rather than the cylindrical wall 46.

Further, while the through-hole 71 formed in the sealing member 70 has a slightly smaller diameter than the outer diameter of the ink needle 102 or the protruding part 151C of the valve 77 in the above-described embodiments, the present disclosure is not limited to this arrangement. That is, at least part of the through-hole 71 may be closed by the elasticity of the sealing member 70 itself when the ink needle 102 is not inserted in the through-hole 71. With this configuration, the coil spring 86 (286, 398) need not be provided in the valve chamber 47 (247, 393). If the coil spring 86 (286, 398) is omitted from the valve chamber 47 (247, 393), then once the ink needle 102 has moved the valve 77 (277, 397) to the second state, the valve 77 (277, 397) will remain in the second state even after the ink needle 102 is extracted from the valve chamber 47 (247, 393). Therefore, the valve 77 (277, 397) does not contact the sealing member 70, but the elasticity of the sealing member 70 can at least partially close the through-hole 71, thereby suppressing the outflow of ink from the valve chamber 47 (247, 393) through the through-hole 71.

In the first through third embodiments, the ink cartridge 30 (330) is mounted in the cartridge-receiving section 110 in a horizontal direction, but the direction in which the ink cartridge 30 (330) moves when being mounted in the cartridge-receiving section 110 is not limited to the horizontal direction, but may be a vertical direction instead.

Although ink serves as an example of liquid in the depicted embodiments, the liquid of the present disclosure may be a pretreatment liquid that is ejected onto the recording sheets prior to the ink during a printing operation, for example, instead of ink.

While the disclosure has been described in detail with reference to the specific embodiments thereof, it would be apparent to those skilled in the art that various changes and modifications may be made therein without departing from the scope of the disclosure.

What is claimed is:

1. A liquid cartridge comprising:

a resin frame defining a portion of a liquid chamber configured to store liquid and a portion of a valve chamber in communication with the liquid chamber, the valve chamber extending in a first direction away from the liquid chamber and having one end in the first direction at which a liquid outlet is provided to provide communication between the valve chamber and an outside of the liquid cartridge, the valve chamber including a first valve chamber and a second valve chamber in communication with each other, the second valve chamber being positioned further in a second direction opposite the first direction relative to the first valve chamber, the frame having a wall portion defining a portion of the valve chamber;

a valve disposed within the valve chamber and movable in the second direction, the valve having a closing part configured to open and close the liquid outlet in accordance with movement of the valve;

a wall member defining the valve chamber together with the wall portion of the frame, wherein the wall portion comprises:

a first wall defining the first valve chamber and including a peripheral wall surface, the peripheral wall surface extending in the first direction and having an annular-shaped cross-section taken along a plane orthogonal to the first direction; and a second wall defining a portion of the second valve chamber, the second wall including a base wall surface defining the another end of the valve chamber in the first direction, the second wall defining an aperture that is open in a third direction perpendicular to the first direction and the second direction, the aperture being closed by the wall member, and an urging member disposed between the valve and the base wall surface within the valve chamber and configured to urge the valve in the first direction.

2. The liquid cartridge as claimed in claim 1, wherein the urging member is arranged in the second valve chamber, and wherein the urging member has an outer diameter greater than a dimension of the first valve chamber in an orthogonal direction orthogonal to the first direction and the second direction and smaller than a dimension of the second valve chamber in the orthogonal direction.

3. The liquid cartridge as claimed in claim 1, wherein the peripheral wall surface is formed with a first opening and a second opening, the second opening being positioned further in the second direction relative to the first opening, the liquid cartridge further comprising:

a first air channel connecting the first opening and the outside of the liquid cartridge to provide communication between the valve chamber and ambient air;

a second air channel connecting the second opening and the liquid chamber to provide communication between the liquid chamber and the valve chamber;

a first sealing part provided on an outer surface of the valve and having an annular shape when viewed in the first direction, the first sealing part being configured to be in close contact with the peripheral wall surface and slide relative thereto in accordance with the movement of the valve; and a second sealing part provided on the outer surface of the valve and having an annular shape when viewed in the first direction, the second sealing part being positioned further in the first direction relative to the first sealing part, the second sealing part being configured to be in close contact with the peripheral wall surface and slide relative thereto in accordance with the movement of the valve, wherein the valve is configured to move between:

a first state in which:

the closing part closes the liquid outlet;

the first sealing part is positioned between the first opening and the second opening to interrupt air flow between the first opening and the second opening; and the second sealing part is positioned further in the first direction relative to the first opening; and a second state in which:

the closing part opens the liquid outlet; and the first opening and the second opening are positioned between the first sealing part and the second sealing part to provide air flow between the first opening and the second opening, and wherein the valve at the second state is disposed further in the second direction relative to the valve at the first state.

4. The liquid cartridge as claimed in claim 3, further comprising a seal member provided at the one end of the valve chamber in the first direction, the seal member having a peripheral surface defining the liquid outlet, wherein the closing part includes a liquid-outlet sealing part configured to be in close contact with the peripheral surface and slide relative thereto in accordance with the movement of the valve between the first state and the second state, the liquid-outlet sealing part on the valve at the first state being in close contact with the peripheral surface to close the liquid outlet, the liquid-outlet sealing part on the valve at the second state being separated from the peripheral surface to open the liquid outlet, and wherein the valve is configured to move from the first state to the second state via an intermediate state in which:

the liquid-outlet sealing part is in close contact with the peripheral surface to close the liquid outlet; and the first opening and the second opening are in communication with each other via a space defined between the first sealing part and the second sealing part to provide air flow between the first opening and the second opening.

5. The liquid cartridge as claimed in claim 3, wherein the valve comprises:

an elastic member through which a through-hole penetrates in the first direction, the elastic member integrally including the first sealing part and the second sealing part; and a retaining member inserted in the through-hole of the elastic member.

6. The liquid cartridge as claimed in claim 3, wherein the first sealing part and the second sealing part have an annular shape when viewed in the first direction and are configured to be in close contact with a particular portion of the peripheral wall surface, the particular portion of the peripheral wall surface having a circular annular-shaped cross-section taken along a plane orthogonal to the first direction.

7. The liquid cartridge as claimed in claim 1, wherein the first direction and the second direction are horizontal when the liquid cartridge is in an operational state to be used, and wherein the valve chamber is positioned higher than a bottom end region of the liquid chamber when the liquid cartridge is in the operational state, the liquid cartridge further comprising a communication path connecting between the liquid chamber and the valve chamber, at least a portion of the communication path being defined by the frame, the frame having a lower end wall defining the bottom end region of the liquid chamber, the lower end wall being formed with a third opening to provide communication between the liquid chamber and the communication path, the wall portion being formed with a fourth opening to provide communication between the valve chamber and the communication path.

8. The liquid cartridge as claimed in claim 1, wherein the wall member is a film.

9. A liquid cartridge comprising:

a liquid chamber configured to store liquid therein;

a valve chamber in communication with the liquid chamber, the valve chamber being defined at least by a base wall surface and a peripheral wall surface, the peripheral wall surface extending in a first direction away from the liquid chamber and having an annular-shaped cross-section taken along a plane orthogonal to the first direction, the peripheral wall surface being formed with a first opening and a second opening, the second opening being positioned further in a second direction opposite the first direction relative to the first opening;

a liquid outlet provided at one end of the valve chamber in the first direction to provide communication between the valve chamber and outside of the liquid chamber;

a first air channel connecting the first opening and an outside of the liquid cartridge to provide communication between the valve chamber and ambient air;

a second air channel connecting the second opening and the liquid chamber to provide communication between the liquid chamber and the valve chamber;

a valve movably disposed within the valve chamber, the valve having a closing part configured to open and close the liquid outlet in accordance with movement of the valve, the valve being formed with a through-hole extending in the first direction;

a first sealing part provided on an outer surface of the valve and having an annular shape when viewed in the first direction, the first sealing part being configured to be in close contact with the peripheral wall surface and slide relative thereto in accordance with movement of the valve;

a second sealing part provided on the outer surface of the valve and having an annular shape when viewed in the first direction, the second sealing part being positioned further in the first direction relative to the first sealing part, the second sealing part being configured to be in close contact with the peripheral wall surface and slide relative thereto in accordance with the movement of the valve;

a third sealing part provided on the outer surface of the valve, the third sealing part being positioned further in the second direction relative to the first sealing part, the third sealing part being configured to be in close contact with the peripheral wall surface and slide relative thereto in accordance with the movement of the valve; and a liquid channel connecting between the liquid chamber and the liquid outlet via the through-hole formed in the valve, wherein the valve is movable, in the first direction and in the second direction, between:

a first state in which:

the closing part closes the liquid outlet;

the first sealing part is positioned between the first opening and the second opening to interrupt air flow between the first opening and the second opening;

the second sealing part is positioned further in the first direction relative to the first opening; and the third sealing part interrupts liquid flow between the second opening and the liquid channel; and a second state in which:

the closing part opens the liquid outlet; and the first opening and the second opening are positioned between the first sealing part and the second sealing part to provide air flow between the first opening and the second opening, and wherein the valve at the second state is positioned further in the second direction relative to the valve at the first state.

10. The liquid cartridge as claimed in claim 9, wherein the peripheral wall surface is formed with a recess, and wherein the third sealing part is configured to come to a position coincident with the recess in the second direction to be separated therefrom in accordance with movement of the valve from the first state in the second direction.

11. The liquid cartridge as claimed in claim 9, wherein the third sealing part has an annular shape when viewed in the first direction, the third sealing part on the valve at the first state being configured to be in close contact with the peripheral wall surface at a position further in the second direction relative to the second opening to interrupt liquid flow between the second opening and the liquid channel.

12. The liquid cartridge as claimed in claim 11, wherein the first sealing part, the second sealing part and the third sealing part have a circular annular shape when viewed in the first direction and are configured to be in close contact with a particular portion of the peripheral wall surface, the particular portion of the peripheral wall surface having a circular annular-shaped cross-section taken along a plane orthogonal to the first direction.

13. The liquid cartridge as claimed in claim 9, further comprising a seal member provided at the one of the valve chamber in the first direction, the seal member having a peripheral surface defining the liquid outlet, wherein the closing part includes a liquid-outlet sealing part configured to be in close contact with the peripheral surface and slide relative thereto in accordance with the movement of the valve, the liquid-outlet sealing part of the closing part on the valve at the first state being in close contact with the peripheral surface to close the liquid outlet, the liquid-outlet sealing part of the closing part on the valve at the second state being separated from the peripheral surface to open the liquid outlet, and wherein the valve is configured to move from the first state to the second state via an intermediate state in which:

the liquid-outlet sealing part is in close contact with the peripheral surface to close the liquid outlet; and the first opening and the second opening are in communication with each other via a space defined between the first sealing part and the second sealing part to provide air flow between the first opening and the second opening.

14. The liquid cartridge as claimed in claim 9, wherein the valve chamber has another end opposite the one end in the first direction, the base wall surface defining the another end of the valve chamber in the first direction, the liquid cartridge further comprising an urging member disposed between the valve and the base wall surface within the valve chamber and configured to urge the valve in the first direction.

15. The liquid cartridge as claimed in claim 9, wherein the valve comprises:

an elastic member formed with the through-hole, the elastic member integrally including the first sealing part, the second sealing part and the third sealing part; and a retaining member inserted in the through-hole of the elastic member to form a space between the retaining member and the elastic member within the through-hole, the space constituting a portion of the liquid channel.

16. A liquid cartridge comprising:

a liquid chamber configured to store liquid therein;

a liquid outlet configured to allow liquid flow therethrough;

a liquid channel connecting between the liquid chamber and the liquid outlet to allow the liquid to flow in a flowing direction from the liquid chamber toward the liquid outlet;

a first closing part configured to open and close the liquid outlet;

an air channel extending from the liquid chamber to an outside of the liquid cartridge to provide communication between the liquid chamber and ambient air;

a valve chamber in communication with the liquid chamber, the valve chamber constituting a portion of the liquid channel and a portion of the air channel;

a second closing part configured to open and close the air channel;

a valve movably disposed within the valve chamber, the valve including the first closing part and the second closing part, the first closing part being configured to open the liquid outlet in accordance with movement of the valve, the second closing part being configured to open the air channel in accordance with the movement of the valve; and a third closing part provided in the liquid channel and configured to open and close the liquid channel, the third closing part having a first surface facing upstream in the flowing direction and a second surface opposite the first surface and facing downstream in the flowing direction, the third closing part being configured to deflect between a closed state and an open state based on a first pressure applied to the first surface and a second pressure applied to the second surface, a difference between the first pressure and the second pressure being defined by subtracting a value of the second pressure from a value of the first pressure, the third closing part deflecting into the closed state when the difference is equal to or greater than a predetermined threshold value, the third closing part deflecting into the open state when the difference is smaller than the predetermined threshold value.

17. The liquid cartridge as claimed in claim 16, wherein the valve chamber is defined by a plurality of wall surfaces including a base wall surface and a peripheral wall surface, the peripheral wall surface extending in a first direction away from the liquid chamber and having an annular-shaped cross-section taken along a plane orthogonal to the first direction, the plurality of wall surfaces being formed with a first opening and a second opening, the peripheral wall surface being formed with at least one of the first opening and the second opening, wherein the air channel comprises:

a first air channel connecting the first opening and the outside of the liquid cartridge to provide communication between the valve chamber and ambient air; and a second air channel connecting the second opening and the liquid chamber to provide communication between the liquid chamber and the valve chamber, wherein the second closing part comprises:

a first sealing part provided on an outer surface of the valve and having an annular shape when viewed in the first direction, the first sealing part being configured to be in close contact with the peripheral wall surface and slide relative thereto in accordance with the movement of the valve; and a second sealing part provided on the outer surface of the valve and having an annular shape when viewed in the first direction, the second sealing part being positioned further in the first direction relative to the first sealing part, the second sealing part being configured to be in close contact with the peripheral wall surface and slide relative thereto in accordance with the movement of the valve, wherein the valve is configured to move between:

a first state in which:

the first closing part closes the liquid outlet;

the first sealing part is positioned between the first opening and the second opening to interrupt air flow therebetween to close the air channel; and the second sealing part is positioned further in the first direction relative to the first opening and the second opening; and a second state in which:

the first closing part opens the liquid outlet; and the first opening and the second opening are positioned between the first sealing part and the second sealing part to provide air flow between the first opening and the second opening to open the air channel, and wherein the valve at the second state is positioned further in a second direction opposite the first direction relative to the valve at the first state.

18. The liquid cartridge as claimed in claim 17, wherein the valve comprises:

an elastic member formed a through-hole extending in the first direction, the elastic member integrally including the first sealing part, the second sealing part and the third closing part; and a retaining member inserted in the through-hole of the elastic member to form a space between the retaining member and the elastic member within the through-hole, the space constituting a portion of the liquid channel, wherein the first surface faces in the second direction and the second surface faces in the first direction, and wherein the retaining member has a third surface opposing the second surface in the first direction, the third closing part deflecting to bring the second surface into contact with the third surface to close the liquid channel.

19. The liquid cartridge as claimed in claim 18, wherein the elastic member has an end wall and a cylindrical wall extending from the end wall in the second direction, the first sealing part and the second sealing part protruding from an outer surface of the cylindrical wall, the end wall including the third closing part.

20. The liquid cartridge as claimed in claim 18, further comprising a seal member provided at one end of the valve chamber in the first direction, the seal member having a peripheral surface defining the liquid outlet, wherein the retaining member includes the first closing part, the first closing part comprising a liquid-outlet sealing part configured to be in close contact with the peripheral surface and slide relative thereto in accordance with the movement of the valve, the liquid-outlet sealing part of the first closing part on the valve at the first state being in close contact with the peripheral surface to close the liquid outlet, the liquid-outlet sealing part of the first closing part on the valve at the second state being separated from the peripheral surface to open the liquid outlet, and wherein the valve is configured to move from the first state to the second state via an intermediate state in which:

the liquid-outlet sealing part is in close contact with the peripheral surface to close the liquid outlet; and the first opening and the second opening are in communication with each other via a space defined between the first sealing part and the second sealing part to provide air flow between the first opening and the second opening to open the air channel.

21. The liquid cartridge as claimed in claim 17, wherein the first opening and the second opening are both formed in the peripheral wall surface, and wherein the first sealing part on the valve at the first state is positioned between the first opening and the second opening to interrupt air flow between the first opening and the second opening.

22. The liquid cartridge as claimed in claim 17, wherein the first sealing part and the second sealing part have a circular annular shape when viewed in the first direction and are configured to be in close contact with a particular portion of the peripheral wall surface, the particular portion of the peripheral wall surface having a circular annular-shaped cross-section taken along a plane orthogonal to the first direction.

23. The liquid cartridge as claimed in claim 17, wherein the liquid chamber has an internal pressure higher than atmospheric pressure when the valve is in the first state.

* * * * *